US012134906B2

(12) United States Patent
An et al.

(10) Patent No.: US 12,134,906 B2
(45) Date of Patent: Nov. 5, 2024

(54) LOAD DISPERSION-TYPE INDOOR LIFTING APPARATUS FOR PREFABRICATED STEEL STRUCTURE AND METHOD OF INSTALLING PREFABRICATED STEEL STRUCTURE BY USING SAME

(71) Applicants: SAMSUNG E&A CO., LTD., Seoul (KR); FPC CO., LTD., Busan (KR)

(72) Inventors: Cheon Keu An, Seoul (KR); Sung Hwan Park, Busan (KR)

(73) Assignees: SAMSUNG E&A CO., LTD., Seoul (KR); FPC CO., LTD., Busan (KR)

( * ) Notice: Subject to any disclaimer, the term of this patent is extended or adjusted under 35 U.S.C. 154(b) by 0 days.

(21) Appl. No.: 18/385,107

(22) Filed: Oct. 30, 2023

(65) Prior Publication Data

US 2024/0175277 A1 May 30, 2024

(30) Foreign Application Priority Data

Nov. 28, 2022 (KR) ..... 10-2022-0162052

(51) Int. Cl.
*E04H 12/20* (2006.01)
*E04G 21/16* (2006.01)
(Continued)

(52) U.S. Cl.
CPC ..... *E04G 21/163* (2013.01); *E04H 12/345* (2013.01); *E04H 12/182* (2013.01);
(Continued)

(58) Field of Classification Search
CPC ..... E04H 12/345; E04H 12/342; E04H 12/20; E04H 12/182; E04H 12/34; E04H 12/344; B66C 23/185; E21B 15/00
See application file for complete search history.

(56) References Cited

U.S. PATENT DOCUMENTS 3,266,211 A * 8/1966 Hughes ..... E04H 12/34 52/745.18
3,324,623 A * 6/1967 Johnson, Jr. ..... B65B 25/046 53/536
(Continued)

FOREIGN PATENT DOCUMENTS

JP H0662098 A 3/1994
JP 2007045591 A 2/2007
(Continued)

OTHER PUBLICATIONS

Notice of Non-Final Rejection, dated May 24, 2023, in corresponding Korean Application No. 10-2022-0162052, 14 pgs.(including English-language translation).
(Continued)

*Primary Examiner* — Phi D A
(74) *Attorney, Agent, or Firm* — Panitch Schwarze Belisario & Nadel LLP

(57) ABSTRACT

Disclosed are a load dispersion-type indoor lifting apparatus for a prefabricated steel structure, and a method of installing a prefabricated steel structure by using the same. The load dispersion-type indoor lifting apparatus for a prefabricated steel structure disclosed herein includes a moving cart, a support frame configured to be mounted on the moving cart, a lifting frame configured to be mounted on the support frame, and a plurality of stacker systems configured to lift up the lifting frame while pushing the support frame down.

30 Claims, 19 Drawing Sheets

(51) Int. Cl.

| | |
|---|---|
| ***E04H 12/34*** | (2006.01) |
| *E04H 12/18* | (2006.01) |
| *E21B 15/00* | (2006.01) |

(52) U.S. Cl.
CPC ..... *E04H 12/20* (2013.01); *E04H 12/342* (2013.01); *E21B 15/00* (2013.01)

(56) References Cited

U.S. PATENT DOCUMENTS

| | | | | |
|---|---|---|---|---|
| 3,921,825 | A * | 11/1975 | Sheehan | B65G 57/24 414/789.5 |
| 4,030,618 | A * | 6/1977 | Kelley | B65G 57/245 414/797.9 |
| 6,464,196 | B1 * | 10/2002 | Crookham | E04H 12/10 248/519 |
| 8,516,751 | B2 * | 8/2013 | Konduc | E21B 7/02 52/143 |
| 10,920,444 | B2 * | 2/2021 | Kensinger | E04H 12/187 |
| 2021/0164255 | A1 * | 6/2021 | Kensinger | E04H 12/187 |

FOREIGN PATENT DOCUMENTS

| | | | |
|---|---|---|---|
| JP | 2019203249 | A | 11/2019 |
| KR | 20130005049 | U | 9/1994 |
| KR | 20130007255 | U | 12/2013 |
| KR | 20150093484 | A | 8/2015 |
| KR | 20180046799 | A | 5/2018 |
| KR | 20190129189 | A | 11/2019 |
| KR | 102113599 | B1 | 5/2020 |
| KR | 102145817 | B1 | 8/2020 |
| KR | 102265499 | B | 6/2021 |
| KR | 102268885 | B1 | 6/2021 |

OTHER PUBLICATIONS

Notice of Allowance, dated Aug. 28, 2023, in corresponding Korean Application No. 10-2022-0162052, 5 pgs (including English-language translation).

* cited by examiner

LOAD DISPERSION-TYPE INDOOR LIFTING APPARATUS FOR PREFABRICATED STEEL STRUCTURE AND METHOD OF INSTALLING PREFABRICATED STEEL STRUCTURE BY USING SAME

CROSS-REFERENCE TO RELATED APPLICATION

This application is based on and claims priority under 35 U.S.C. § 119 to Korean Patent Application No. 10-2022-0162052, filed on Nov. 28, 2022, in the Korean Intellectual Property Office, the disclosure of which is incorporated by reference herein in its entirety.

BACKGROUND

1. Field

The disclosure relates to a load dispersion-type indoor lifting apparatus for a prefabricated steel structure, and a method of installing a prefabricated steel structure by using the same. More particularly, the disclosure relates to a load dispersion-type indoor lifting apparatus for a prefabricated steel structure, and a method of installing a prefabricated steel structure by using the same, wherein the load dispersion-type indoor lifting apparatus is configured to efficiently install a heavy-load prefabricated steel structure even in areas with an extremely low allowable load capacity for floor by distributing an applied load generated from lifting of the prefabricated steel structure within the allowable load capacity for floor.

2. Description of the Related Art

In order to mount a lower support (or mount a connecting member that can be suspended from the top of a structure and installed by hanging from the structure) after lifting a prefabricated heavy steel structure (hereinafter also referred to as "module") and fix it in an accurate position, a method of using a strand jack-up device has been conventionally used. However, the process of fixing a heavy module to an accurate position by lifting and lowering it with a strand jack-up device is extremely time-consuming, and moreover, to use a strand jack-up device, it is necessary to apply embedded plates and weld lug plates to the frame area of an upper beam. That is, to efficiently apply an existing installation method for a prefabricated heavy steel structure, operations such as embedded plate installation and lug plate welding are necessarily required in structural frames, and this results in a relatively longer work time, fire hazards due to welding, decreased work efficiency, and safety hazards due to increased high place work.

Further, in principle, lifting of modules is impossible in locations where no embedded plates are installed, and even in RC frame structures and PC frame structures, lifting is impossible unless a separate lifting lug plate is installed. For example, if a frame structure is prepared by a PC method, embedded plates need to be installed during PC preparation, and this installation requires a very complex manufacturing process, which causes an increase in material costs and a delay in construction time. As another example, if the frame structure is a steel frame structure, a lug plate capable of jack-up operation needs to be attached to the steel frame structure, and for this attachment, structural reinforcement such as an installation of stiffeners is required, and on-site welding is difficult (sometimes impossible due to concerns that it might cause a change in material properties) so that lug plates may be prefabricated beforehand at the steel frame structure manufacturing plants and then delivered to the job site. As another example, in case of LFC and LFG frame structure construction methods, embedded plates need to be pre-installed at manufacturing plants before LFC and LFG are manufactured.

Further, after the construction of frame structures with embedded plates, lug plates need to be welded on-site, which causes fire hazards and requires additional personnel, such as fire watchers. Further, to be able to deliver lug plates to a job site and install them, vertical and horizontal movements need to be performed, and the handling of heavy loads requires additional personnel such as signalmen and guides, and lifting aid such as forklifts and cranes.

Further, after welding the lug plates, wires for strand jack-up need to be installed, and after moving modules, jack-up hydraulic devices and jigs need to be installed on the wires. This wire installation takes place at a high position, which requires table lifting equipment, and since the wires are heavy, the installation requires a large number of personnel.

Further, equipment for moving heavy loads, such as forklifts, are needed to move jack-up hydraulic devices and hydraulic pumps, and in addition, power connections, hydraulic hose connections and lifting jig connections are also required.

Further, a slow lifting speed creates long wait times, and after lifting, the equipment needs to be dissembled and dismantled in the reverse order of lifting, and this process is all done manually and therefore requires a great number of personnel and consumes time.

Further, in cases in which the construction structure is a steel structure, not a concrete structure, strand jack-up devices can only be used if the structure is reinforced with stiffeners, or if lug plates are welded beforehand to prevent deformation of the steel structure. Therefore, the material of the steel structure may be exposed to thermal deformation.

In addition, construction costs may increase due to heavy equipment rental and hot work, and as the number of pieces of equipment stored on-site increases, occupying the space and workspace on the job site, there are many cumbersome tasks that need to be performed, such as moving the equipments as the construction progresses, which can make construction work inefficient.

Further, the operations may take a long time, and problems such as complexity due to the use of long wires for strand jack-up devices in complex sites and the risk of fire due to welding, may occur.

Further, there may be inconveniences in that when transporting lifting jigs to be used after storage, they are required to be transported by a forklift or by manpower, and hydraulic devices, and hydraulic hoses used for connection between hydraulic devices and hydraulic actuators are required to be transported by a forklift.

SUMMARY

Additional aspects will be set forth in part in the description which follows and, in part, will be apparent from the description, or may be learned by practice of the presented embodiments of the disclosure.

Provided is a load dispersion-type indoor lifting apparatus for a prefabricated steel structure, configured to efficiently install a heavy-load prefabricated steel structure even in areas with an extremely low allowable load capacity for floor while distributing the applied load generated from lifting of the prefabricated steel structure within the bounds of the allowable load capacity for floor.

Provided is a method of installing a prefabricated steel structure by using the apparatus.

According to an aspect of the disclosure, a load dispersion-type indoor lifting apparatus for a prefabricated steel structure includes:

a moving cart;

a support frame configured to be mounted on the moving cart;

a lifting frame configured to be mounted on the support frame; and a plurality of stacker systems configured to lift the lifting frame upwards while pushing the support frame down.

The support frame and the lifting frame may be configured to partially overlap each other when coupled, such that the total thickness of the assembly of the support frame and the lifting frame may be less than the sum of an actual thickness of the support frame and an actual thickness of the lifting frame.

The support frame may include a plurality of transverse bars spaced apart from each other and arranged parallel to each other, a plurality of longitudinal bars coupled with end portions of the plurality of transverse bars so as to connect the end portions of the plurality of transverse bars to each other, and a plurality of vertical bars spaced apart from each other and vertically coupled to an assembly of the plurality of transverse bars and the plurality of longitudinal bars.

The support frame may further include a plurality of outrigger supports protruding outward from and being coupled to lower end portions of the vertical bars, respectively.

The support frame may be configured to be separated into two or more parts, and in this case, among the plurality of longitudinal bars, two adjacent longitudinal bars may be configured to be separated.

The lifting frame may include a plurality of transverse bars spaced apart from each other and arranged parallel to each other, and a plurality of longitudinal bars coupled to end portions of the plurality of transverse bars so as to connect the end portions of the plurality of transverse bars to each other.

The lifting frame may further include a plurality of expandable fork supports coupled to bottom surfaces of longitudinal bars while protruding outward from or being inwardly embedded into the bottom surfaces of the longitudinal bars, respectively.

Each of the plurality of expandable fork supports may include a pin coupled to a bottom surface thereof.

The lifting frame may be configured to be separated into two or more parts, wherein among the plurality of longitudinal bars, two adjacent longitudinal bars may be configured to be separated.

The load dispersion-type indoor lifting apparatus for a prefabricated steel structure may further include a plurality of fine position adjusting devices mounted on the lifting frame and configured to bring a horizontal movement and a rotational movement to the prefabricated steel structure.

At least one of the support frame and the lifting frame may further include a plurality of lifting lugs.

Each of the plurality of stacker systems may include a pair of first masts, a pair of second masts coupled to the pair of first masts in a vertically slidable manner, an electric panel, a pair of front outriggers, a fork coupled to the pair of second masts and configured to vertically slide together as the pair of second masts vertically slide, a pair of side outriggers, and a pair of rear outriggers.

The fork may include a hole formed on a top surface thereof.

The pair of front outriggers, the pair of side outriggers, and the pair of rear outriggers may have an automatic leveling function with respect to an unlevel bottom portion.

Each of the plurality of stacker systems may further include a first mast reinforcing bar configured to couple the pair of first masts to each other so as to ensure structural safety of the pair of first masts and prevent deformation thereof.

Each of the plurality of stacker systems may further include a second mast reinforcing bar configured to couple the pair of second masts to each other so as to ensure structural safety of the pair of second masts and prevent deformation thereof.

The load dispersion-type indoor lifting apparatus for a prefabricated steel structure may further include a communication line embedded in the support frame and the lifting frame and configured to be connected to all of the plurality of stacker systems.

The load dispersion-type indoor lifting apparatus for a prefabricated steel structure may further include a power cable embedded in the support frame and the lifting frame and configured to be connected to all of the plurality of stacker systems.

The load dispersion-type indoor lifting apparatus for a prefabricated steel structure may further include a plurality of support beams configured to support a lower part of the prefabricated steel structure after the prefabricated steel structure is lifted.

The load dispersion-type indoor lifting apparatus for a prefabricated steel structure may further include at least one of a first additional support beam and a second additional support beam, wherein the first additional support beam is configured to support a rear outrigger of each stacker system, and the second additional support beam is configured to support a front outrigger and a rear outrigger while a side outrigger is folded.

According to another aspect of the disclosure, a method of installing a prefabricated steel structure by using the load dispersion-type indoor lifting apparatus for a prefabricated steel structure includes:

obtaining an assembly by mounting the lifting frame on the support frame (S10);

by operating the moving cart, moving the moving cart under a lower part of the assembly, and bringing the lower part of the assembly and an upper part of the moving cart in contact with each other (S20);

by operating the moving cart, moving the assembly under a lower part of a prefabricated steel structure, and bringing the lower part of the prefabricated steel structure and an upper part of the assembly in contact with each other (S30); and placing the plurality of stacker systems in a row on one side and on the other side of the assembly (S40).

The method of installing a prefabricated steel structure by using a load dispersion-type indoor lifting apparatus for a prefabricated steel structure may further include, after S40, connecting a communication line and a power cable embedded in the support frame and the lifting frame to all of the plurality of stacker systems (S50).

The method of installing a prefabricated steel structure by using a load dispersion-type indoor lifting apparatus for a prefabricated steel structure may further include, after S50, automatically leveling the stacker systems with respect to a level or unlevel bottom portion by adjusting a height of at least one outrigger selected from among a pair of front outrigger, a pair of side outriggers, and a pair of rear outriggers of the stacker systems.

In S60, the side outriggers are extended to support the bottom portion, or the rear outriggers are extended to support an additional support beam pre-installed on the bottom portion.

The method of installing a prefabricated steel structure by using a load dispersion-type indoor lifting apparatus for a prefabricated steel structure may further include, after S60, operating each stacker system to push down an outrigger support of the support frame by the front outriggers, and pushing up an expandable fork support of the lifting frame by a fork to separate and lift the lifting frame from the support frame, thereby lifting the prefabricated steel structure (S70).

The method of installing a prefabricated steel structure by using a load dispersion-type indoor lifting apparatus for a prefabricated steel structure may further include, after S70, mounting a plurality of support beams on a lower part of the prefabricated steel structure (S80).

The method of installing a prefabricated steel structure by using a load dispersion-type indoor lifting apparatus for a prefabricated steel structure may further include, after S80, finely adjusting the position of the prefabricated steel structure by operating a plurality of fine position adjusting devices mounted on the lifting frame (S90).

The method of installing a prefabricated steel structure by using a load dispersion-type indoor lifting apparatus for a prefabricated steel structure may further include, after S90, operating each stacker system to lower the prefabricated steel structure to a reference height (S100).

The method of installing a prefabricated steel structure by using a load dispersion-type indoor lifting apparatus for a prefabricated steel structure may further include, after S100, operating each stacker system to lower the fork to lower the lifting frame along with the expandable fork support of the lifting frame to thereby mount the lifting frame onto the support frame and obtain the assembly again, and then raising the front outriggers to separate the same from the outrigger support of the support frame (S110).

The method of installing a prefabricated steel structure by using a load dispersion-type indoor lifting apparatus for a prefabricated steel structure may further include, after S110, separating a communication line and a power cable connected to all of the plurality of stacker systems and embedding the communication line and the power cable in the support frame and the lifting frame (S120).

The method of installing a prefabricated steel structure by using a load dispersion-type indoor lifting apparatus for a prefabricated steel structure may further include, after S120, moving the assembly from the lower part of the prefabricated steel structure to a storage site by operating the moving cart (S130).

Advantageous Effects

A load dispersion-type indoor lifting apparatus for a prefabricated steel structure according to an embodiment of the disclosure may have advantages as follows:

(1) Even in areas inside a building with a low allowable load capacity for floor, it is possible to install and fix a heavy steel structure to an accurate position by lifting the steel structure and finely adjusting its position, while distributing an applied load generated from the lifting of prefabricated steel structure (module) within the allowable load capacity for floor.

(2) It is possible to increase lifting efficiency by synchronizing a plurality of lifting devices, and at the same time, simultaneously lift or lower one block or multiple blocks of heavy steel structures (modules) safely.

(3) Because a bottom-fixed type prefabricated steel structure (module) can be efficiently lifted up or lowered down, it is possible to shorten construction duration, decrease on-site construction difficulty, and minimize the risk and likelihood of safety-related accidents.

(4) A top-fixed type prefabricated steel structure can be installed by efficient lifting up or down, or through fine positioning.

(5) Transportation and installation of a prefabricated structure can be performed sequentially by using the apparatus, and by means of wheels for self-driving, the apparatus is allowed to move in east, west, south, and north directions inside a building.

(6) Use of the apparatus disclosed herein in installation of a prefabricated structure eliminates the needs for embedded plates, wire installation, lug plates, and welding of lug plates that are essential to a conventional method, and therefore, efficiency can improve from reduced preliminary work and reduced use of heavy machinery needed for preliminary work, and removal of hot work can reduce fire hazards.

(7) Further, unlike manually-moved conventional apparatus, the apparatus disclosed herein is operated by battery, thereby preventing musculoskeletal diseases; and since even the frames can be moved by a self-propelled modular transporter (SPMT) used for module transportation, mechanized and automated construction can be realized, thus preventing musculoskeletal diseases.

(8) The conventional strand jack-up technique requires moving of lifting jigs installed by hanging on wires; however, moving of the lifting jigs requires a forklift or a number of workers to manually push the lifting jigs. To address such inconveniences, a lifting apparatus, which is battery-powered and movable by a remote controller, is realized.

(9) Even in areas wherein the column spacing of a building is large or small, by distributing a load to the floor slab of the building, heavy-load modules can be lifted and installed without reinforcement of slabs of the structure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
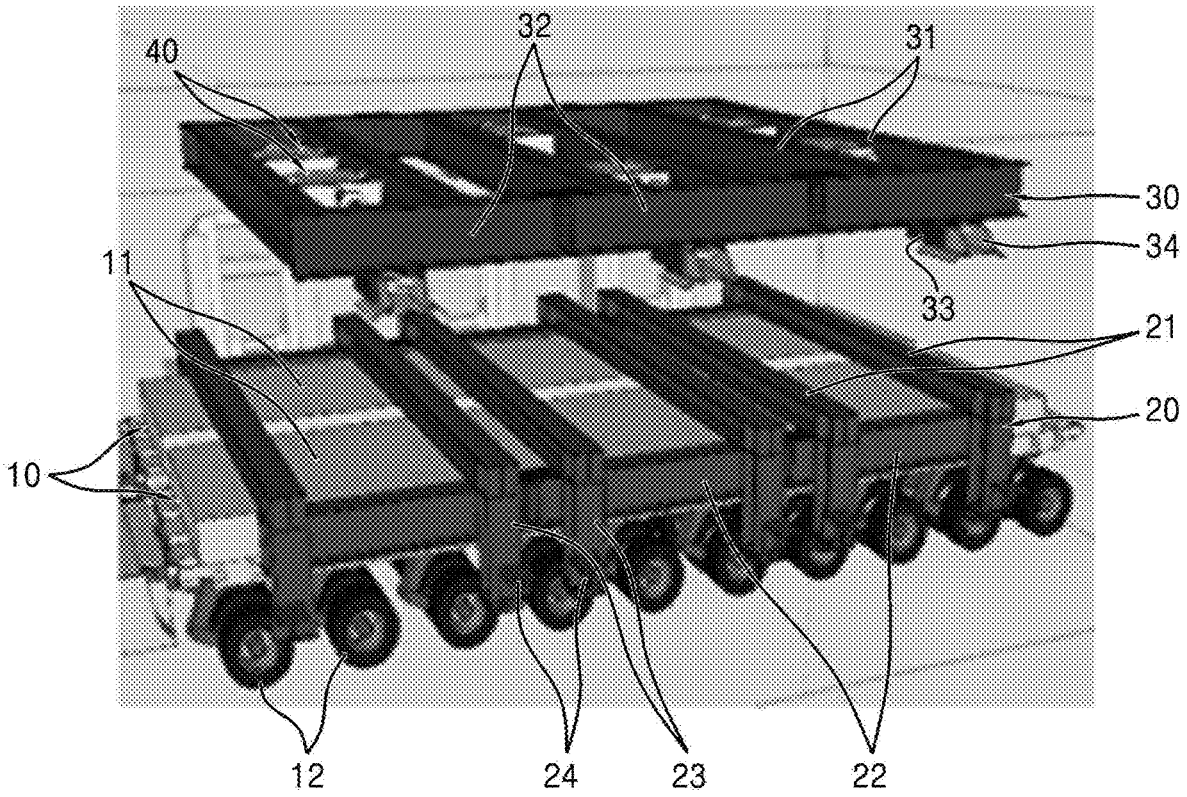
FIG. 1 is a diagram showing the configuration and coupling of a moving cart, a support frame, and a lifting frame of a load dispersion-type indoor lifting apparatus for a prefabricated steel structure according to an embodiment of the disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

Hereinbelow, a load dispersion-type indoor lifting apparatus for a prefabricated steel structure according to an embodiment of the disclosure will be described in greater detail with reference to the drawings.

As used herein, the term "outrigger" refers to a member that fixes the position and adjusts the height of a stacker system, and also serves to distribute the load applied to the stacker system to a target support (e.g., a bottom portion or an additional support beam) and a support frame when lifting a heavy-load prefabricated steel structure.

As used herein, the term "upper" refers to a portion located at a relatively upper side based on the direction of gravity, and the term "lower" refers to a portion located at a relatively lower side based on the direction of gravity.

As used herein, the term "leveling" and "to level" refer to adjusting the height of a stacker system in all directions so as to bring the stacker system into a state as though the stacker system is placed on a level ground.

Figure 2:
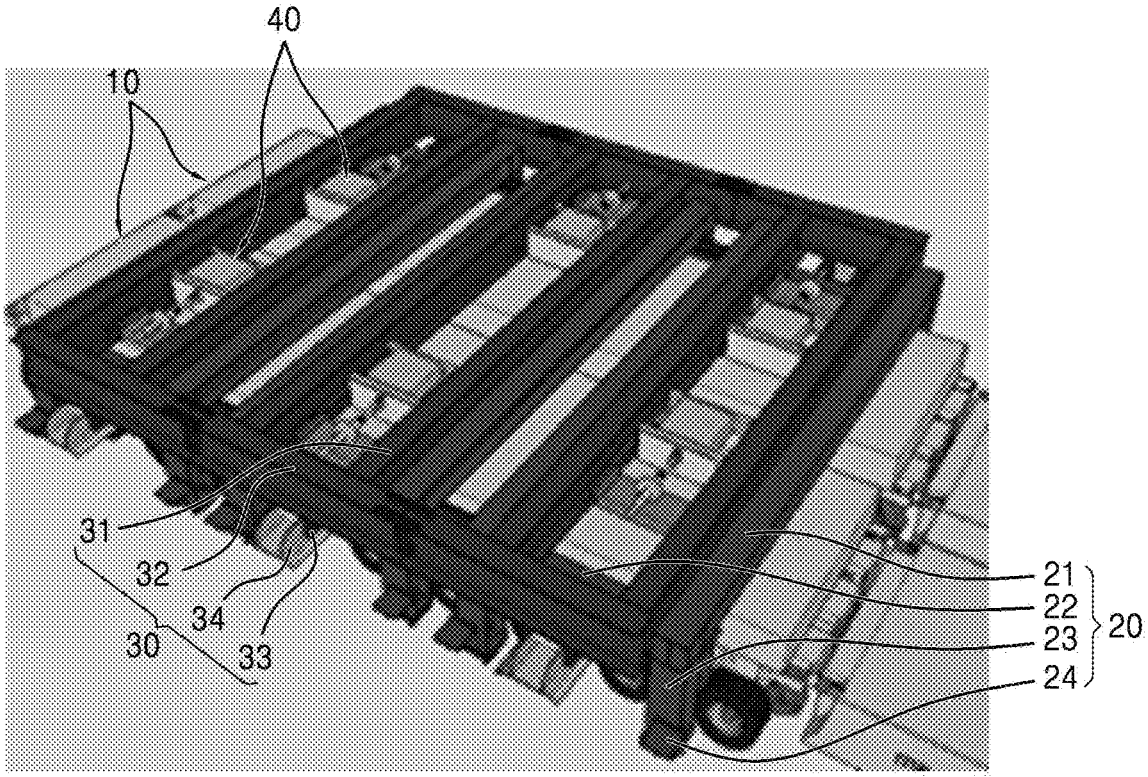
FIG. 2 is a diagram showing the configuration and coupling of a moving cart, a support frame, and a lifting frame of a load dispersion-type indoor lifting apparatus for a prefabricated steel structure according to an embodiment of the disclosure, viewed from a different angle than FIG. 1.
Figure 3:
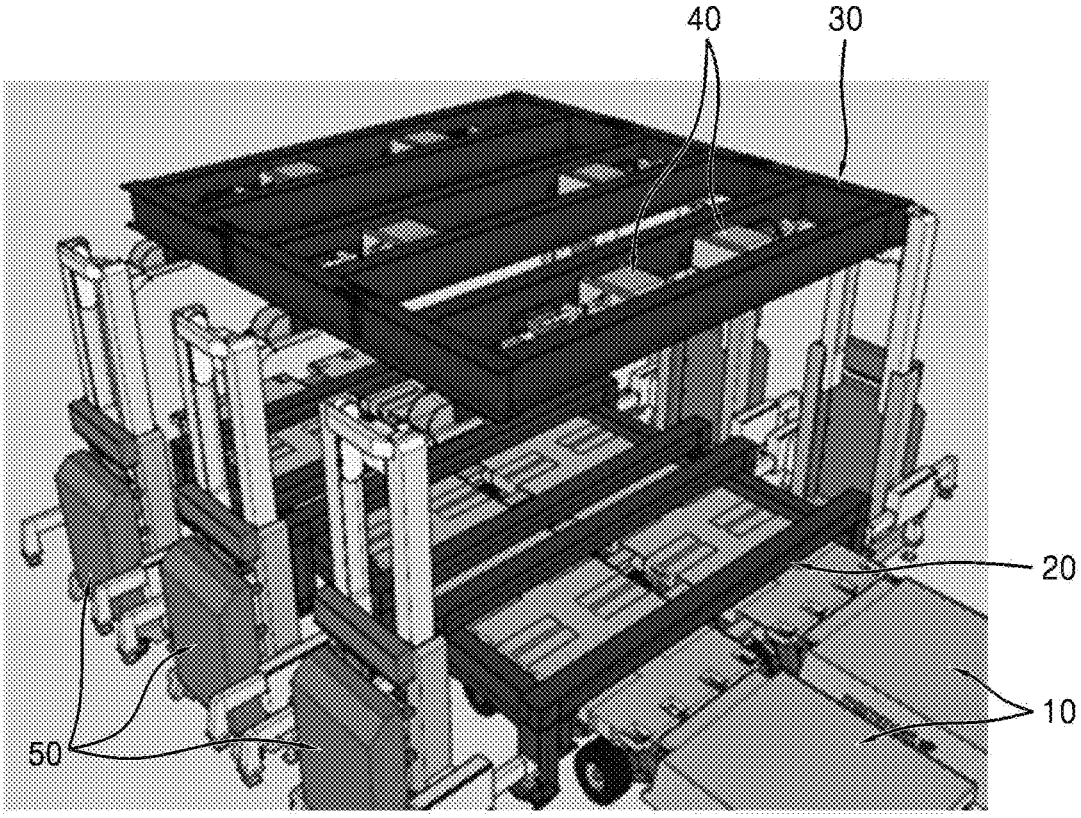
FIG. 3 is a diagram showing the configuration and coupling of a moving cart, a support frame, a lifting frame, and a stacker system constituting a load dispersion-type indoor lifting apparatus for a prefabricated steel structure according to an embodiment of the disclosure.
Figure 4:
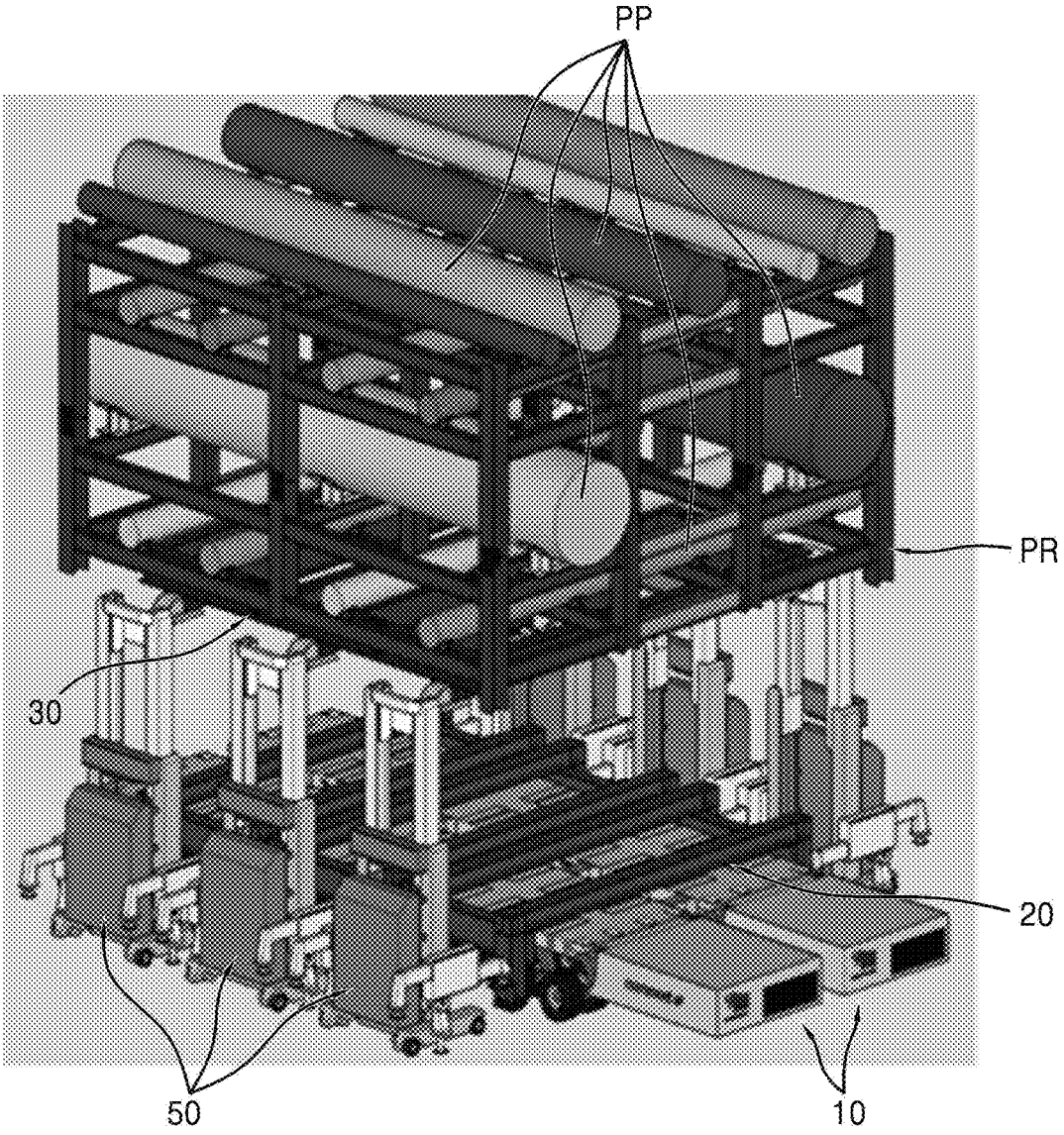
FIG. 4 is a diagram illustrating the mechanism through which a prefabricated steel structure is lifted by a moving cart, a support frame, a lifting frame, and a stacker system constituting a load dispersion-type indoor lifting apparatus for a prefabricated steel structure according to an embodiment of the disclosure.

FIG. 1 is a diagram showing the configuration and coupling of a moving cart 10, a support frame 20, and a lifting frame 30 of a load dispersion-type indoor lifting apparatus for a prefabricated steel structure PR according to an embodiment of the disclosure, FIG. 2 is a diagram showing the configuration and coupling of a moving cart 10, a support frame 20, and a lifting frame 30 of a load dispersion-type indoor lifting apparatus for a prefabricated steel structure PR according to an embodiment of the disclosure, viewed from a different angle than FIG. 1;

FIG. 3 is a diagram showing the configuration and coupling of a moving cart 10, a support frame 20, a lifting frame 30, and a stacker system 50 constituting a load dispersion-type indoor lifting apparatus for a prefabricated steel structure PR according to an embodiment of the disclosure; and FIG. 4 is a diagram illustrating the mechanism through which a prefabricated steel structure PR is lifted by a moving cart 10, a support frame 20, a lifting frame 30, and a stacker system 40 constituting a load dispersion-type indoor lifting apparatus for a prefabricated steel structure PR according to an embodiment of the disclosure.

Referring to FIGS. 1 to 4, a load dispersion-type indoor lifting apparatus for a prefabricated steel structure PR according to an embodiment of the disclosure includes a moving cart 10, a support frame 20, a lifting frame 30, and a plurality of stacker systems 50.

The prefabricated steel structure PR may be a pipe rack, but the present disclosure is not limited thereto. The prefabricated steel structure PR may be a structure prefabricated to reduce a construction duration and decrease on-site construction difficulty and may be a structure constructed by prefabrication in a low position without substructures.

The moving cart 10 may include a body 11 and a plurality of wheels 12.

Further, the moving cart 10 may be configured such that the body 11 can be raised or lowered based on the wheels 12.

Further, the moving cart 10 may include a plurality of hydraulic suspensions and be configured to distribute a load applied to the support frame 20 mounted on top of the moving cart 10 to the plurality of wheels 12.

For example, the moving cart 10 may be a self-propelled modular transporter (SPMT), but is not limited thereto. SPMTs, which are equipment used for transporting heavy objects, are self-powered and self-driving as the name suggests, and are transportation equipment that are manufactured to be modular and thus can flexibly meet a variety of needs.

Further, the moving cart 10 may be lowered in its height and introduced under a lower part of the assembly of the support frame 20 and the lifting frame 30, separately stored on-site.

Further, the moving cart 10 may be increased in its height to lift up and move the assembly of the support frame 20 and the lifting frame 30 to the installation site of a prefabricated steel structure PR, and move the assembly under a lower part of the prefabricated steel structure PR without interference with a bottom portion BT.

Further, the moving cart 10 moved under the lower part of the prefabricated steel structure PR may be raised in its height to bring an upper part of the assembly of the support frame 20 and the lifting frame 30 to be in close contact with the lower part of the prefabricated steel structure PR.

If the load of the prefabricated steel structure PR increases, the effect of distributing the load may be achieved by increasing the length of the moving cart 10 or increasing the number of wheels to which the load is distributed, so that the lifted load acts within the range of the allowable load capacity for a building structure.

The support frame 20 may be configured to be mountable on the moving cart 10.

For example, the support frame 20 may include a plurality of transverse bars 21, a plurality of longitudinal bars 22, and a plurality of vertical bars 23.

The plurality of transverse bars 21 may be spaced apart from each other and arranged parallel to each other.

The plurality of longitudinal bars 22 may be coupled to end portions of the plurality of transverse bars 21 such that the end portions of the plurality of transverse bars 21 are connected to each other by the plurality of longitudinal bars 22.

The plurality of vertical bars 23 may be spaced apart from each other and may be vertically coupled to the assembly of the plurality of transverse bars 21 and the plurality of longitudinal bars 22.

In addition, the support frame 20 may further include a plurality of outrigger supports 24.

The plurality of outrigger supports 24 may receive a load applied to the stacker system 50 through the front outriggers 54 of the stacker system 50, and distribute the load applied to the stacker systems 50 sequentially to the entire support frame 20 and the entire moving cart 10.

For example, the plurality of outrigger supports 24 may be coupled to protrude outward (that is, outside of the outer edge of the support frame 20) one by one at the lower end portion of each vertical bar 23.

Further, the support frame 20 may be configured to be separated into two or more parts. In this case, two adjacent longitudinal bars 22 among the plurality of longitudinal bars 22 may be configured to be separated. In particular, the support frame 20 may be configured to be separated into dimensions within the bounds of allowable vehicle dimensions to ensure its general road movability, and the support frame 20 and the lifting frame 30 may be configured such that these two members even in a separated state are able to remain coupled to each other and transported by a single vehicle. More specifically, the support frame 20 may be separated into 3 parts. The support frame 20 may have ensured movability by having heavy-load wheels attached to four locations to allow the support frame 20 to move even in a separated state.

Further, the support frame 20 may have a lug installed thereon to allow the support frame 20 to be lifted by a crane in a separated state, and may have a separate lug attached thereon to allow the support frame 20 to be lifted by a crane even when the 3 separated parts are re-assembled together.

Further, the support frame 20 may have supports shaped like table legs (that is, vertical bars 23) installed thereon to ensure storage convenience and a sufficient space for entering and exiting of the moving cart 10, and to allow the support frame 20 to move in south and north directions, east and west directions, and/or diagonal directions, the support frame 20 may be configured to be convenient to move by having heavy-load wheels attached to a lower part thereof. The attached heavy-load wheels may be configured to be rotatable by 90° angle and fixed, such that these heavy-load wheels can be moved in south and north directions, and in east and west directions without a crash with columns inside a building. Further, by removing a fixing pin, the heavy-load wheel may change to be rotatable at a free angle, allowing for diagonal direction, rotational turning, and the like.

The lifting frame 30 may be configured to be mountable on the support frame 20.

For example, the lifting frame 30 may include a plurality of transverse bars 31 and a plurality of longitudinal bars 32.

The plurality of transverse bars 31 may be spaced apart from each other and arranged parallel to each other.

The plurality of longitudinal bars 32 may be coupled to end portions of the plurality of transverse bars 31 such that the end portions of the plurality of transverse bars 31 are connected to each other by the plurality of longitudinal bars 32.

In addition, the lifting frame 30 may further include a plurality of expandable fork supports 34.

The plurality of expandable fork supports 34 may be raised along as a fork 54 of the stacker system 50 is raised, thereby serving to raise the entire lifting frame 30 and the entire pipe rack PR sequentially. In this case, the lifting frame 30 may be raised, and the support frame 20 may be fixed in position as a front outrigger 54 of the stacker system 50 pushes down an outrigger support 24 of the support frame 20. Therefore in such a case, the support frame 20 and the lifting frame 30 may be separated from each other.

For example, each of a plurality of expandable fork supports 34 may be coupled to a bottom surface of each vertical bar 32 while protruding in an outward direction (that is, out of the outer edge of the lifting frame 30) or while being inserted inwardly (that is, inside the outer edge of the lifting frame 30). To this end, a housing 30 accommodating the expandable fork support 34 may be mounted on a lower portion of the lifting frame 30, and the expandable fork support 34 may slide along the housing 33 to protrude outwardly or be inserted thereinto, as needed.

Further, each of the plurality of expandable fork supports 34 may include a pin (not illustrated) coupled to a bottom surface thereof.

Further, the lifting frame 30 may be configured to be separated into two or more parts. In this case, two adjacent longitudinal bars 32 among the plurality of longitudinal bars 32 may be configured to be separated. In particular, one lifting frame 30 may be separated into 3 parts in consideration of allowable vehicle dimensions on roads.

The lifting frame 30 may have a lug installed thereon to allow the lifting frame 30 to be lifted by a crane in a separated state, and may have a separate lug attached thereon to allow the lifting frame 30 to be lifted by a crane even when the 3 separated parts are re-assembled together.

Further, the support frame 20 and the lifting frame 30 may be configured to partially overlap each other when coupled. Thus, the total thickness of an assembly of the support frame 20 and the lifting frame 30 may be smaller than the sum of an actual thickness of the support frame 20 and an actual thickness of the lifting frame 30. To this end, a gap and length of the transverse bars 21 of the support frame 20, and a gap and length of the transverse bars 31 of the lifting frame 30 may be appropriately controlled in consideration of a decrease in the total thickness of the assembly, durability maintenance, and the like.

Further, the support frame 20 and the lifting frame 30 may be coupled together and separately stored on-site.

Further, when the support frame 20 and the lifting frame 30 are overlapped such that a portion of the lifting frame 30 is embedded inside the support frame 20, a beveled guide may be attached to a contact area so as to naturally guide the support frame 20 and the lifting frame 30 to overlap so as to ensure smooth coupling. The beveled portion attached may be configured to serve a protective function for a fine position adjusting device 40 installed inside the lifting frame 30 when the lifting frame 30 is stored alone, and also to serve a support function similar to a table leg for transportation and storage convenience.

In one or more embodiments, the load dispersion-type indoor lifting apparatus for a prefabricated steel structure may further include a plurality of fine position adjusting devices 40.

The plurality of fine position adjusting devices 40 may be mounted on the lifting frame 30 and configured to bring horizontal movement and rotational movement to the prefabricated steel structure PR.

In particular, the prefabricated steel structure PR may be lifted while being supported on top of the fine position adjusting devices 40, and the fine position adjusting devices 40 may include a slide using a bearing (not illustrated) and a hydraulic cylinder system for moving the slide, and may be configured to enable fine position adjustments in X and Y directions.

Further, the fine position adjusting devices 40 may be installed on various locations on the lifting frame 30 depending on the shape of the prefabricated steel structure PR, and as described above, the fine position adjusting devices 40 may be configured to enable position adjustments in X and Y directions by a hydraulic device. Further, a combination of a plurality of hydraulic devices mounted on the plurality of fine position adjusting devices 40 may be configured so as to bring the prefabricated steel structure PR into rotation in a clock-wise or counterclock-wise direction.

The fine position adjusting device 40 may be mounted on the lifting frame 30 to support the prefabricated steel structure PR, and bolts and bolt holes fixing the fine position adjusting device 40 to the lifting frame 30 may be processed in an elongated shape in a longitudinal direction and provided so as to enable a change in the position of the fine position adjusting device 40. By changing the position of the fine position adjusting device 40, supporting the prefabricated steel structure PR may still be ensured even if a change occurs in the shape of the prefabricated steel structure PR and the position of a girder.

In addition, the fine position adjusting device 40 installed on the lifting frame 30 operates by receiving communication and power. However, a connector device may be provided at a detachable part of the lifting frame 30 so that the communication and power lines can be separated when the lifting frame 30 is separated and moved, thereby easily connecting and separating the communication and power lines. position adjusting device In one or more embodiments, the load dispersion-type indoor lifting apparatus for a prefabricated steel structure may further include a plurality of support beams SB.

The plurality of support beams SB may be configured to support a lower part of the prefabricated steel structure PR after the prefabricated steel structure PR is lifted (see FIG. 10, FIG. 11, and FIGS. 15 to 18).

Figure 19:
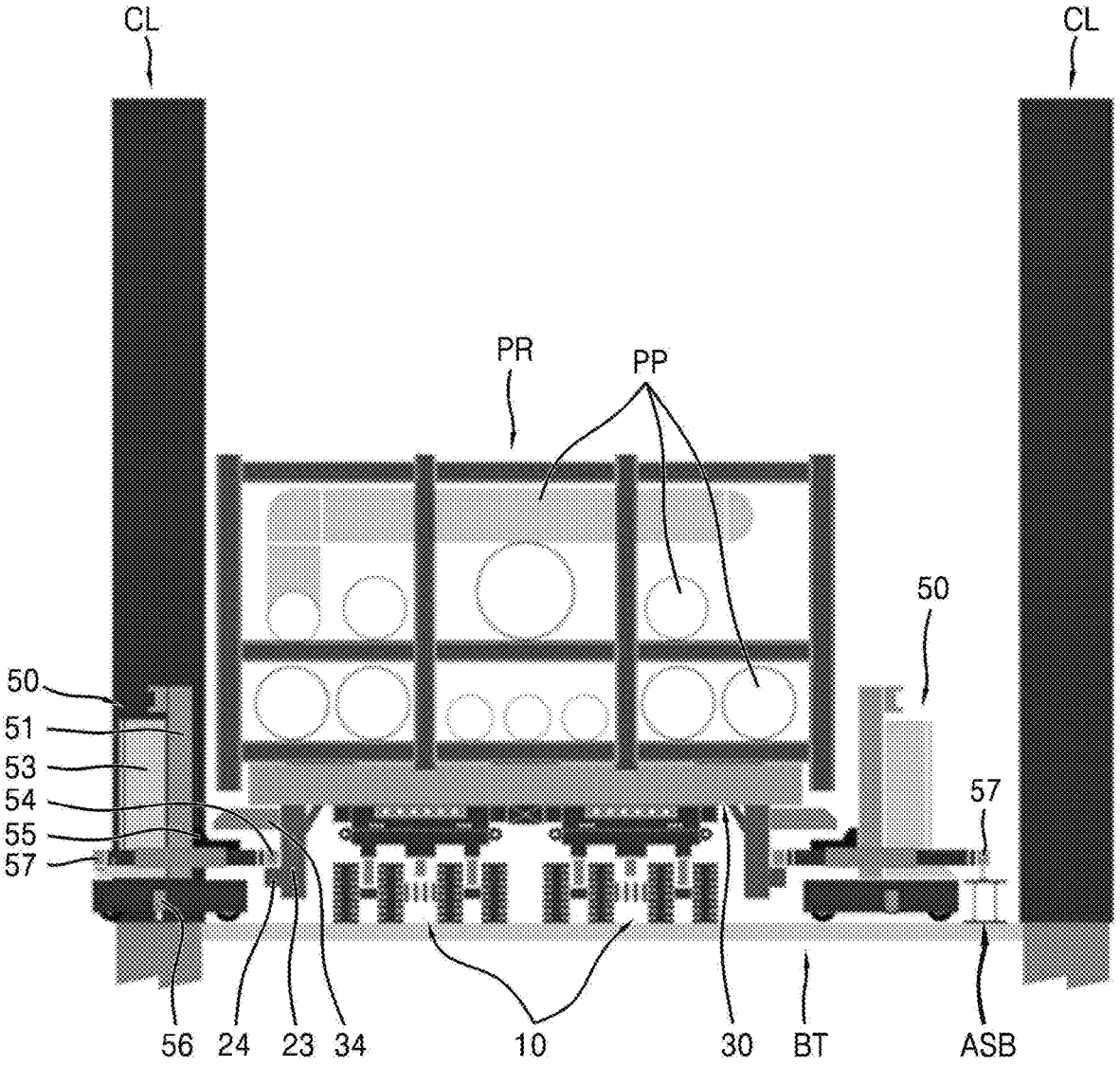

Further, the load dispersion-type indoor lifting apparatus for a prefabricated steel structure may further include one or more additional support beams (ASB) to distribute the lifted load of a prefabricated steel structure to beams or sub-beams of the building structure even in sections where the structural column spacing (span) is large (see FIG. 19).

The ASB may include at least one of a first ASB and a second ASB, wherein the first ASB is configured to support a rear outrigger 57 of each stacker system 50 and the second ASB is configured to support a front outrigger 54 and the rear outrigger 57 while a side outrigger 56 is folded (see FIG. 19).

Figure 5:
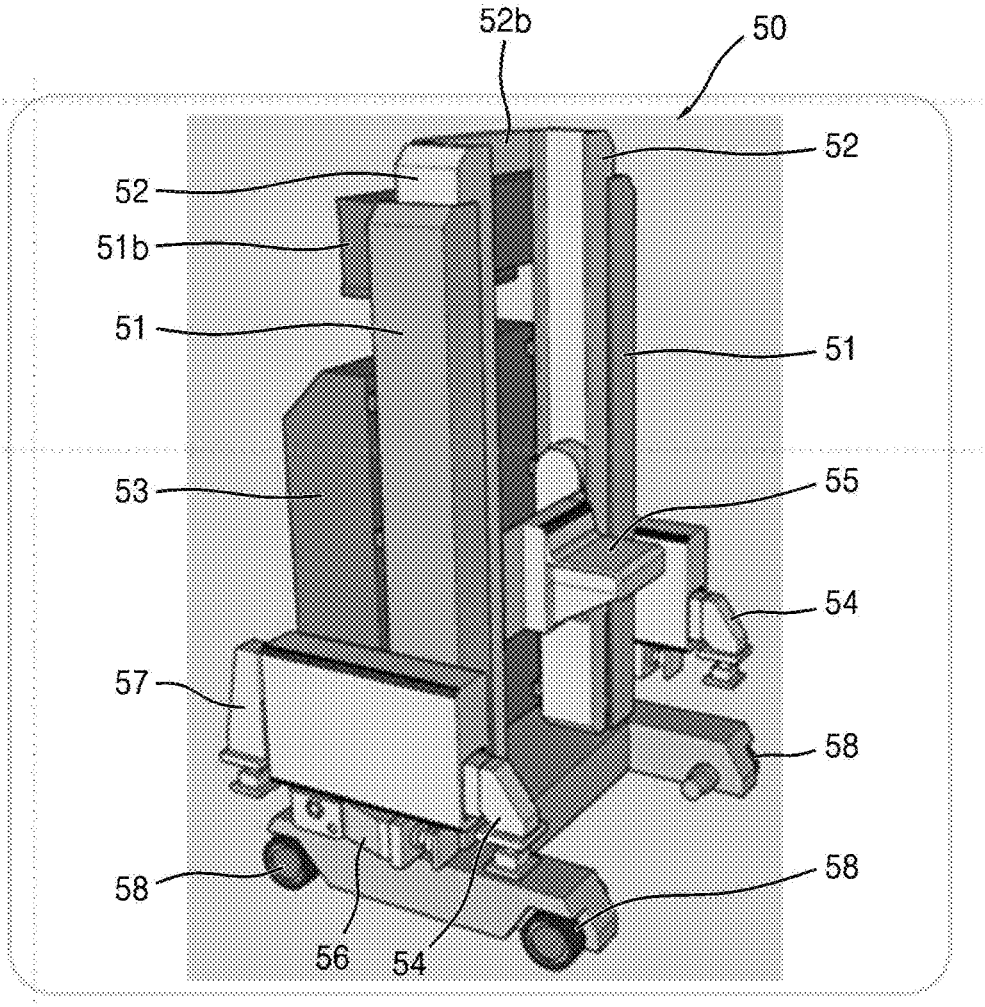
FIG. 5 is a diagram showing the configuration of a stacker system of a load dispersion-type indoor lifting apparatus for a prefabricated steel structure according to an embodiment of the disclosure.

FIG. 5 is a diagram showing the configuration of a stacker system 50 of a load dispersion-type indoor lifting apparatus for a prefabricated steel structure PR according to an embodiment of the disclosure.

The stacker system 50 may be configured to move to a lifting position by operating an electric motor by its own battery power.

Further, the stacker system 50 moved to the lifting position may be precisely position-adjusted to be able to lift a lifting frame 30.

Further, in the stacker system 50 moved to the lifting position and precisely position-adjusted at the position, outriggers 54, 56, 57, which will be described below, may be automatically set by a self-setting function.

Referring to FIG. 5, the stacker system 50 may include a pair of first masts 51, a pair of second masts 52, an electric panel 53, a pair of front outriggers 54, a fork 55, a pair of side outriggers 56, a pair of rear outriggers 57, and a plurality of wheels 58.

The pair of first masts 51 may be fixed in position.

The pair of second masts 52 may be coupled to the pair of first masts 51 in a vertically slidable manner.

Further, the stacker system 50 may further include one or more pairs of additional masts, such as a pair of third masts (not illustrated) coupled to the pair of second masts 52 in a vertically slidable manner, a pair of fourth masts (not illustrated) coupled to the pair of third masts in a vertically slidable manner, and the like.

An electric panel 53 may be coupled to the pair of first masts 51, the pair of second masts 52, and/or other parts and may be configured to supply electricity and transmit signals to each part of the stacker system 50.

The pair of front outriggers 54 may push the outrigger support 24 of the support frame 20 down, thereby distributing sequentially a load applied to the stacker system 50 to the entire support frame 20 and the entire moving cart 10.

In particular, the pair of front outriggers 54 may be configured to be able to move forward and backward.

The fork 55 may sequentially lift the entire lifting frame 30 and the entire prefabricated steel structure PR while separating the lifting frame 30 from the support frame 20 by pushing the expandable fork support 34 of the lifting frame 30 up.

Further, if the stacker system 50 further includes one or more pairs of additional masts, such as a pair of third masts (not illustrated) coupled to the pair of second masts 52 in a vertically slidable manner, a pair of fourth masts (not illustrated) coupled to the pair of third masts in a vertically slidable manner, and the like, the fork 55 may be configured to be coupled to a most-highly raisable pair of additional masts, and configured to be able to slide vertically together as the corresponding pair of additional masts slide vertically.

In particular, the fork 55 may be coupled to the pair of second masts 52 and configured to be able to slide vertically together as the pair of second masts 52 slide vertically.

Further, the fork 55 may include a hole (not illustrated) formed on a top surface thereof. Therefore, even when a slippage or the like occurs as a pin coupled to a bottom surface of the expandable fork support 34 couples to the hole formed on the top surface of the stacker system 50 to lift the prefabricated steel structure PR to a higher position, the lifting may be safely carried out due to the mechanical coupling of the pin and the hole.

The pair of side outriggers 56 may serve to fix the stacker system 50 in position by supporting the bottom portion BT, adjust the height of the stacker system 50 by adjusting a cylinder stroke of the side outriggers 56, or distribute a load applied to the stacker system 50 to the bottom portion BT (that is, a target support portion). Here, the target support portion may refer to a reinforced bottom section (that is, the location of a slab above a beam) of a column member on-site.

In particular, the pair of side outriggers 56 may be folded in a horizontal direction. In particular, by adding an additional support beam ASB under the pair of front outriggers 24 and the pair of rear outriggers 57, a heavy object may be lifted by distributing the lifted load of the prefabricated steel structure PR to beams or sub-beams of a building structure without the support frame 20. Further, the pair of side outriggers 56 may be configured to be expandable at various angles.

In case of the pair of rear outriggers 57, when the outriggers 54, 56, 57 of the stacker system 50 are to be applied to slabs of a building because the column spacing of the building is larger than normal, the pair of rear outriggers 57 should be used since the side outriggers 56 are unavailable to use in such a case.

When the pair of rear outriggers 57 are to be used, an additional support beam ASB in the form of an H-beam transversing across a main beam or a sub-beam may be disposed on the bottom portion BT, and the pair of rear outriggers 57 may be mounted on top of the additional support beam ASB, so that the lifted load can be transmitted to the additional support beam ASB through the pair of rear outriggers 57, and thus applied to the beam instead of the slabs. Even in a case in which a hole is installed for installation of a duct shaft or a pipe shaft, operations may be carried out using the pair of rear outriggers 57 and the additional support beam ASB as described above.

Further, the pair of front outriggers 54, the pair of side outriggers 56, and the pair of rear outriggers 57 may have an automatic leveling function with respect to a level bottom portion BT or an unlevel bottom portion BT. The automatic leveling function will be described in detail below.

Further, the pair of front outriggers 54, the pair of side outriggers 56, and the pair of rear outriggers 57 may have an overturning prevention function even when lifting heavy objects.

Further, each stacker system 50 may further include a first mast reinforcing bar 51*b* configured to couple the pair of first masts 51 to each other so as to ensure structural safety of the pair of first masts 51 and prevent deformation thereof. In particular, for the fork 55 to be raised, the pair of second masts 52 is raised up on the pair of first masts 51, and at the same time, between the pair of second masts 52 and by a chain (not illustrated), the fork 55 is also raised by the same height by which the pair of second masts 52 is raised. As such, when the fork 55 rises upward, a lateral load applied to the pair of first masts 51 and/or the pair of second masts 52 increases, and as a result, the pair of first masts 51 and/or the pair of second masts 52 facing each other may be diverged further apart from each other or deformed in a twisted shape, or may bend under bending moment. Here, the first deformation that may occur may be a phenomenon in which the pair of second masts 52 fall off from the inside of the pair of first masts 51 to the outside as the gap between the upper ends of the pair of first masts 51 facing each other widens. The first mast reinforcing bar 51*b* serves to prevent the pair of first-stage masts 51 from spreading.

In addition, each stacker system 50 may further include a second mast reinforcing bar 52*b* configured to ensure structural safety of the pair of second masts 52 and hold them together so that deformation thereof does not occur. More specifically, when the fork 55 rises toward upper parts of the pair of second masts 52, similarly, the distance between the upper parts of the pair of second masts 52 increases, which may cause a bearing (not illustrated) of the fork 55 to come off from the inside of the pair of second masts 52. The second mast reinforcing bar 52*b* serves to prevent the pair of second masts 52 from spreading.

As a result, the first-mast reinforcing bar 51*b* and the second-mast reinforcing bar 52*b* may increase durability of the stacker system 50 by protecting the stacker system 50 from deformations caused by a load applied thereto.

Further, the support frame 20 may be configured to be able to lift a prefabricated steel structure PR by four or six stacker systems 50 depending on the load of the prefabricated steel structure PR. When lifting a prefabricated steel structure PR by using four stacker systems 50 because the prefabricated steel structure PR is light, lifting may be performed by coupling the front outriggers 54 only to outrigger supports 24 installed in the outer part of the support frame 20, without using outrigger supports 24 installed in the mid-section of the support frame 20.

Similarly, the lifting frame 30 may be configured to be able to lift a prefabricated steel structure PR by four or six stacker systems 50 depending on the load of the prefabricated steel structure PR. When lifting a prefabricated steel structure PR by using four stacker systems 50 because the prefabricated steel structure PR is light, lifting may be performed by expanding only four expandable fork supports 34 installed in the outer part of the lifting frame 30, without expanding expandable fork supports 34 installed in the mid-section of the lifting frame 30.

Further, the load dispersion-type indoor lifting apparatus for a prefabricated steel structure PR may further include a communication line.

Figure 6:
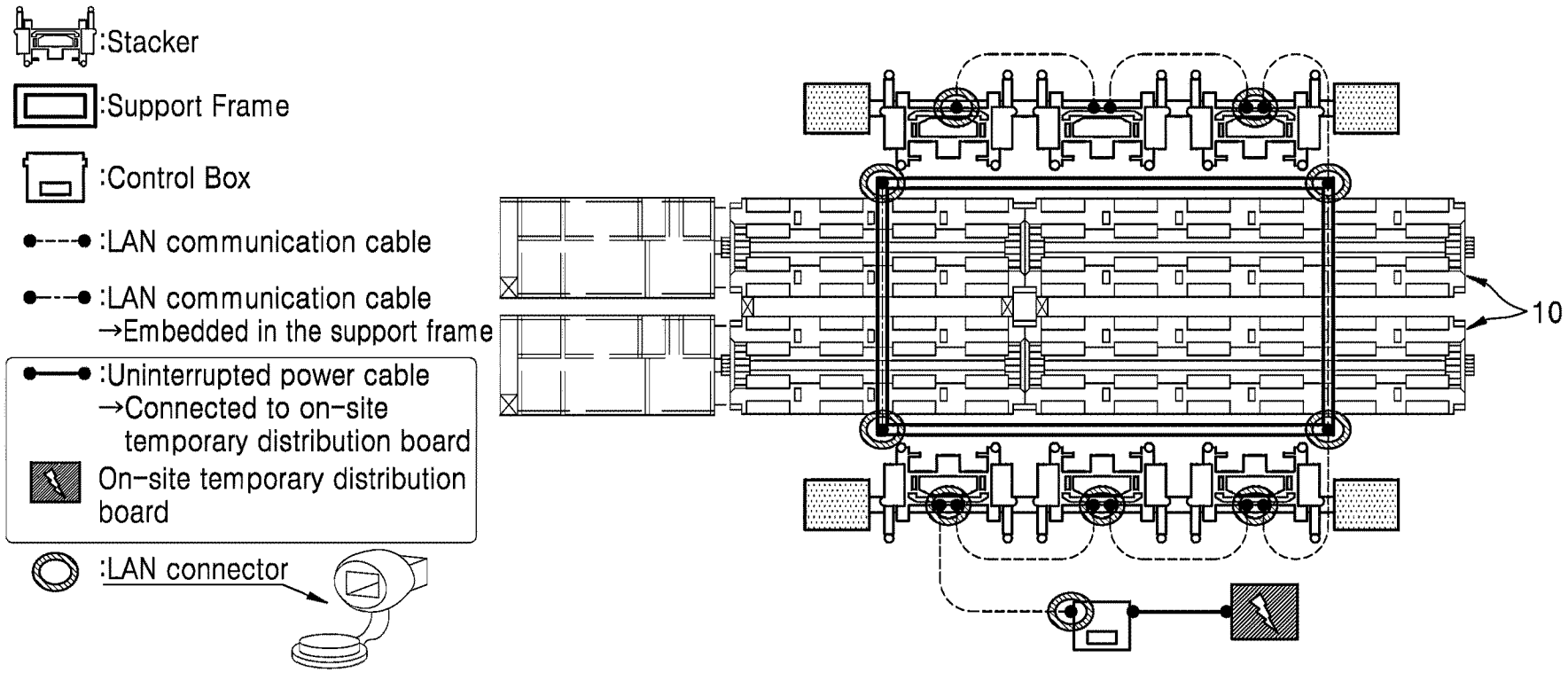
FIG. 6 is a diagram showing the state in which a communication line is embedded in a support frame and a lifting frame and connected to an entire stacker system in a load dispersion-type indoor lifting apparatus for a prefabricated steel structure according to an embodiment of the disclosure.

Referring to FIG. 6, the communication line may be embedded inside the support frame 20 and the lifting frame 30 and configured to be connected to the entire stacker systems 50. In one or more embodiments, the support frame 20 and the lifting frame 30 may have a communication cable embedded therein for transmitting signals to a plurality of stacker systems 50 installed on two opposing sides thereof, so that because the communication cable is not placed on the bottom portion BT, there is no interference due to the communication cable during moving and lifting of the prefabricated steel structure PR, and the cable can be also protected from damage or causing interferences due to movement of the moving cart 10, vehicles used for transportation, and other goods irrelevant to the lifting of the prefabricated steel structure PR.

Further, the load dispersion-type indoor lifting apparatus for a prefabricated steel structure may further include a power cable.

Figure 7:
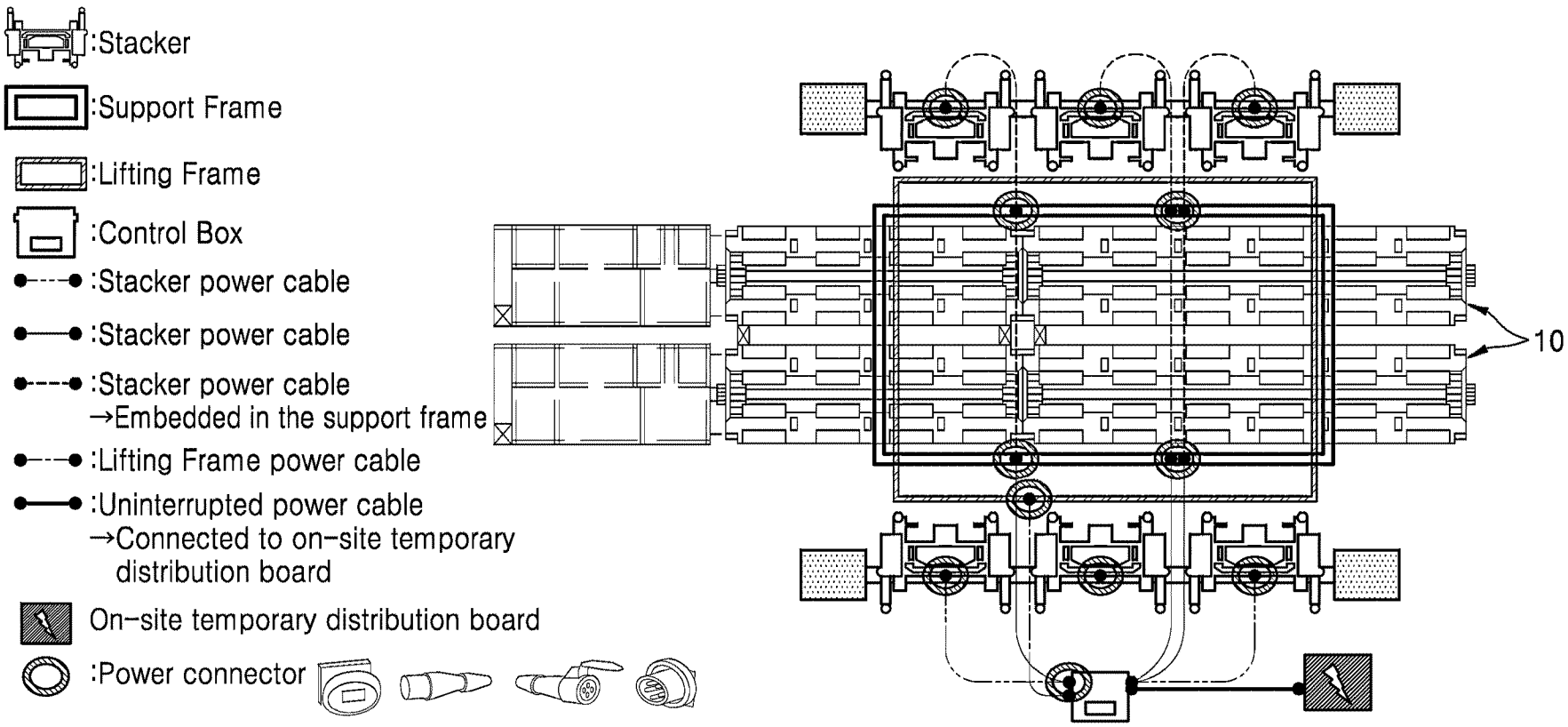
FIG. 7 is a diagram showing the state in which a power cable is embedded in a support frame and a lifting frame and connected to an entire stacker system in a load dispersion-type indoor lifting apparatus for a prefabricated steel structure according to an embodiment of the disclosure.

Referring to FIG. 7, the power cable may be embedded inside the support frame 20 and the lifting frame 30 and configured to be connected to the entire stacker systems 50. In one or more embodiments, the support frame 20 and the lifting frame 30 may have a power cable embedded therein for supplying power to a plurality of stacker systems 50 installed on two opposing sides thereof, so that because the power cable is not placed on the bottom portion BT, there is no interference due to the power cable during moving and lifting of the prefabricated steel structure PR.

Hereinbelow, a method of installing a prefabricated steel structure by using the above-described load dispersion-type indoor lifting apparatus for a prefabricated steel structure will be described in greater detail with reference to FIGS. 8 to 19.

Figure 8:
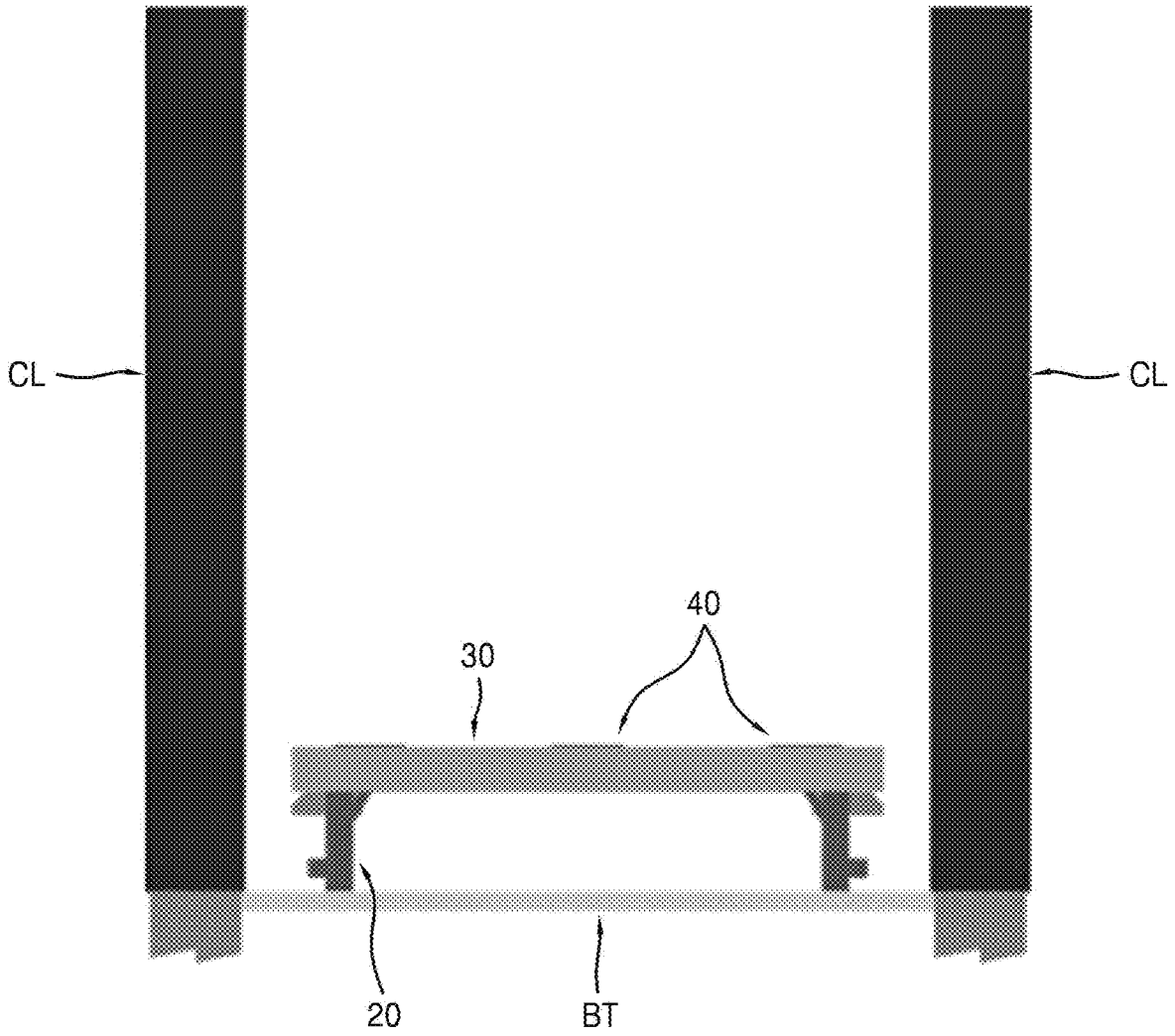
FIGS. 8 to 19 are diagrams showing, step by step, a method of installing a prefabricated steel structure by using a load dispersion-type indoor lifting apparatus for a prefabricated steel structure, configured to efficiently install a heavy-load prefabricated steel structure.

First, as illustrated in FIG. 8, the support frame 20 and the lifting frame 30 may be coupled to each other to obtain an assembly (S10). In particular, on a bottom portion (BT)

between columns (CL) of a building structure, the support frame 20 and the lifting frame 30 may be coupled together to obtain an assembly.

Figure 9:
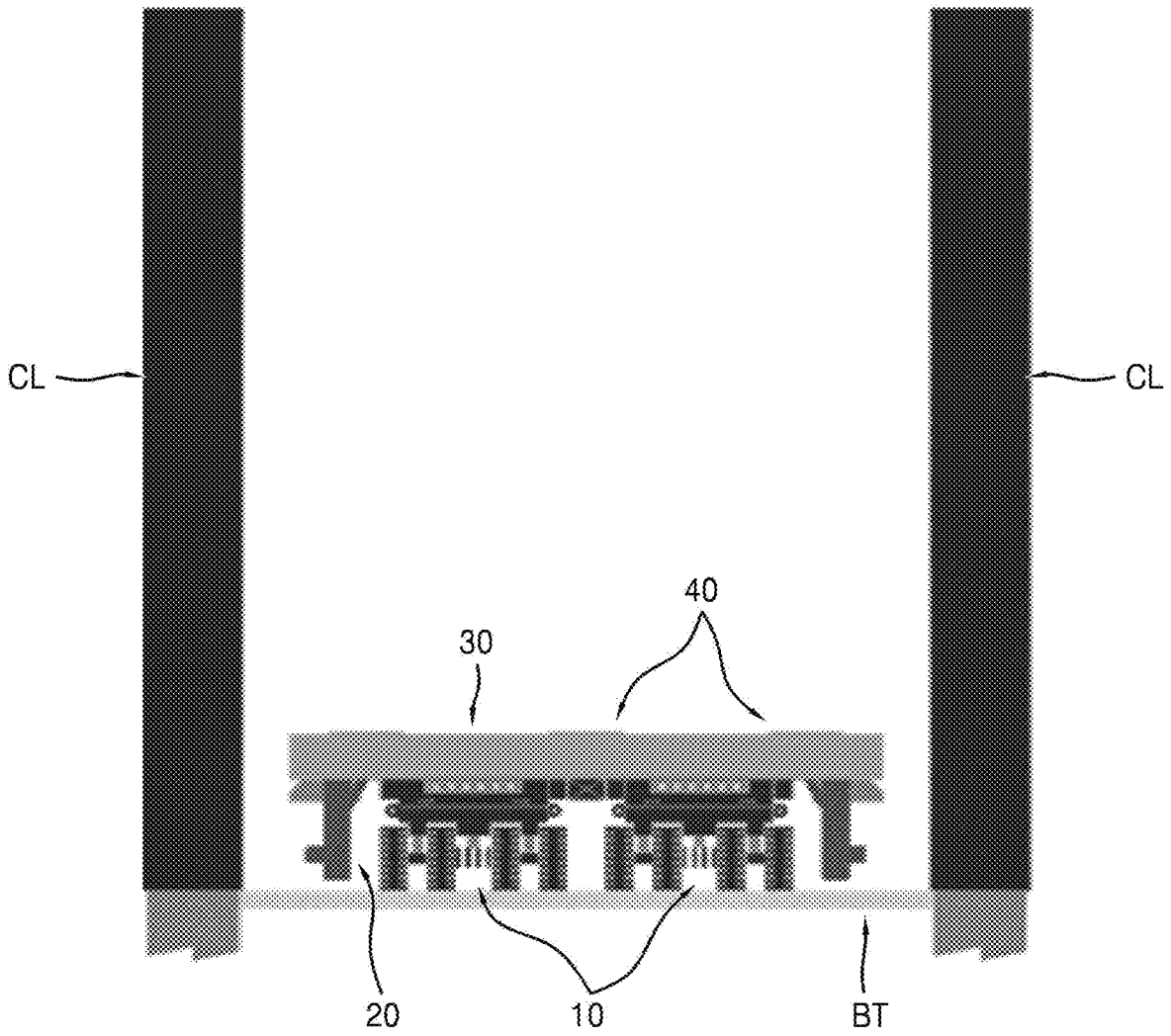

Next, as illustrated in FIG. 9, by operating the moving cart 10, the moving cart 10 may be moved under a lower part of the assembly, and the height of a body 11 of the moving cart 10 may be adjusted to bring the lower part of the assembly (more specifically, the support frame 20) and an upper part of the moving cart 10 (more specifically, the body 11) into close contact with each other (S20).

Figure 10:
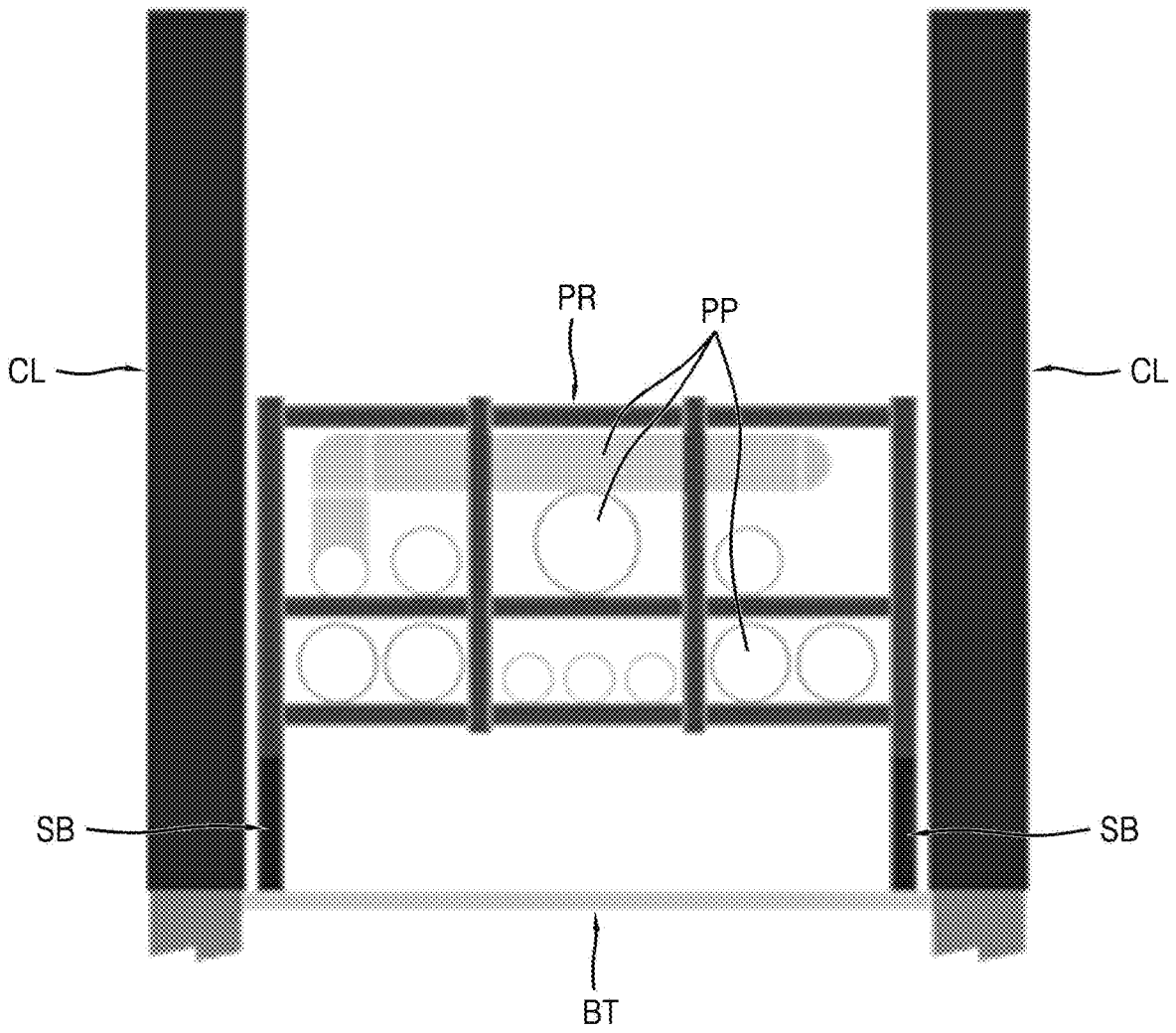
Figure 11:
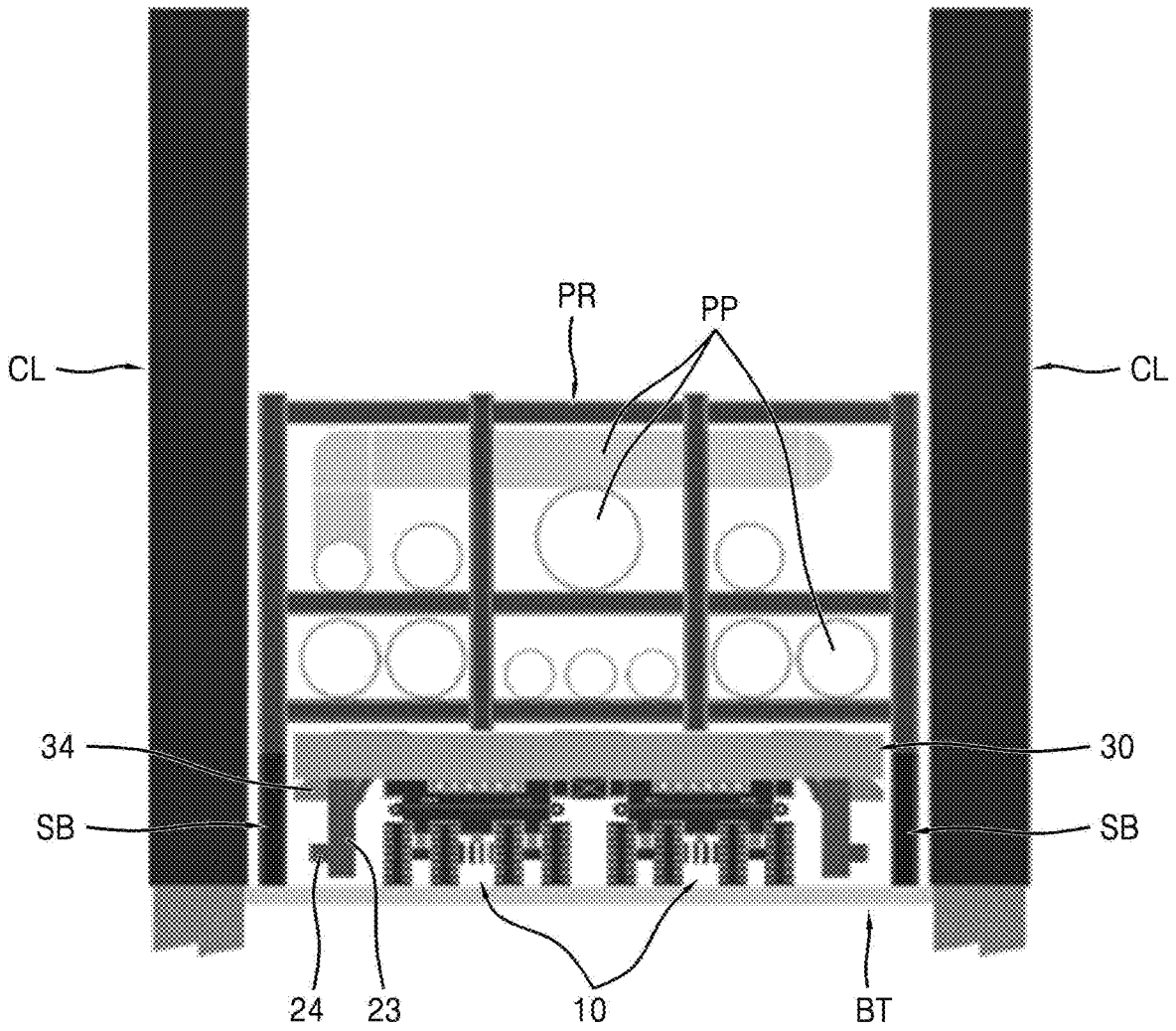
Figure 12:
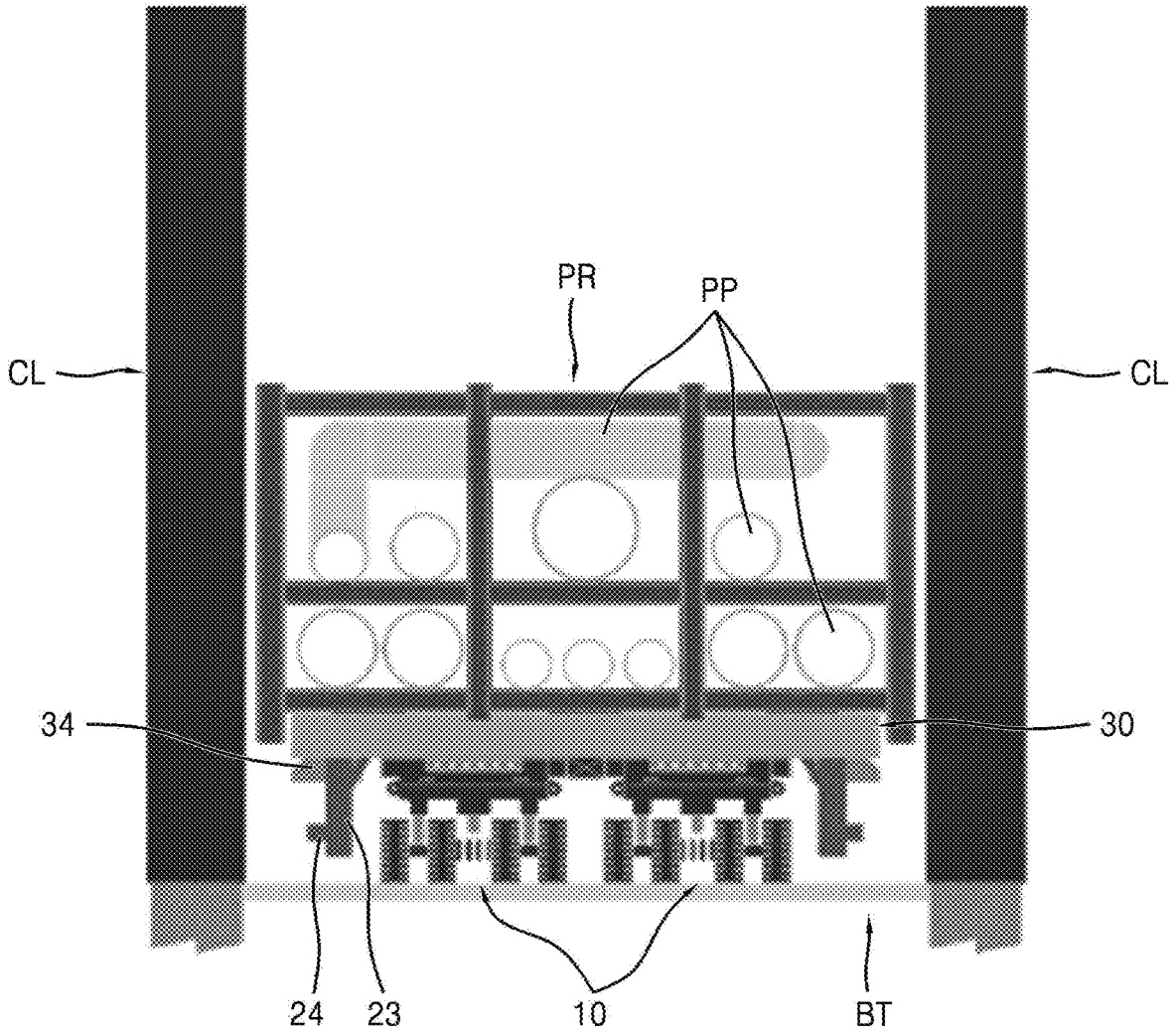

Next, as illustrated in FIGS. 10 to 12, after moving the assembly under the lower part of the prefabricated steel structure PR by operating the moving cart 10, the lower part of the prefabricated steel structure PR may be close contact with an upper part of the assembly (in particular, the lifting frame 30) by adjusting the height of the body 11 of the moving cart 10 (S30). Here, a temporary support beam SB mounted on a lower part of the prefabricated steel structure PR may be removed.

Figure 13:
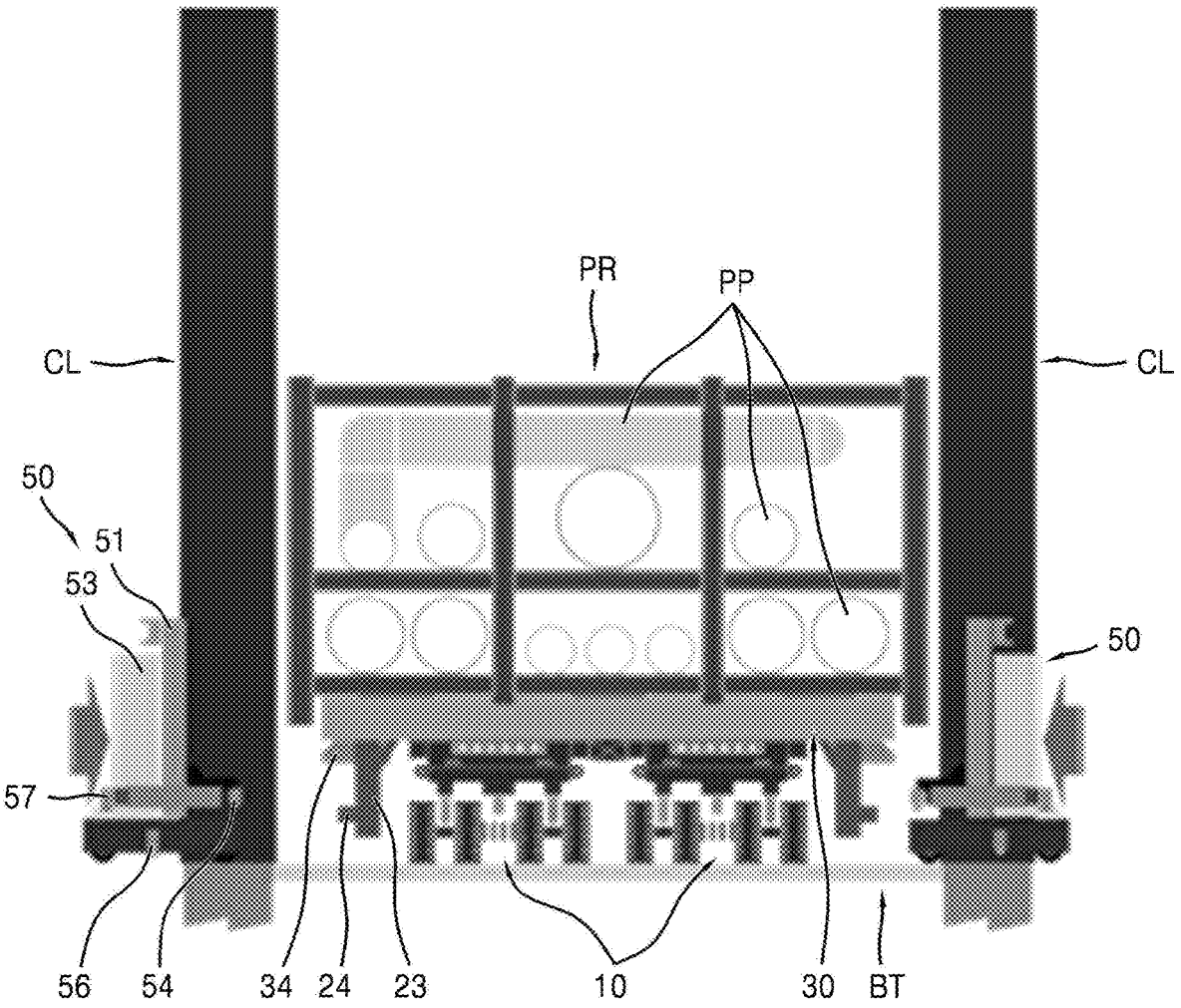

Next, as illustrated in FIG. 13, a plurality of stacker systems 50 may be arranged in a row on one side and the other side of the assembly (S40).

Next, after S40, a communication line and a power cable embedded inside the support frame 20 and the lifting frame 30, or separately stored, may be connected to all of the plurality of stacker systems 50 (S50).

Next, after S50, the stacker systems 50 may be automatically levelled with respect to a level or unlevel bottom portion BT by adjusting the height of at least one outrigger selected from among a pair of front outrigger 54, a pair of side outriggers 56, and a pair of rear outriggers 57 of the stacker systems (S60). For example, the stacker system 50 may be automatically levelled by operating the pair of front outriggers 54 and the pair of side outriggers 56, or the stacker system 50 may be automatically levelled by operating the pair of front outriggers 54 and the pair of rear outriggers 57.

Further, in S60, the side outriggers may be expanded to support the bottom portion BT, or the rear outriggers are expanded to support an additional support beam ASB pre-installed on the bottom portion BT.

Figure 14:
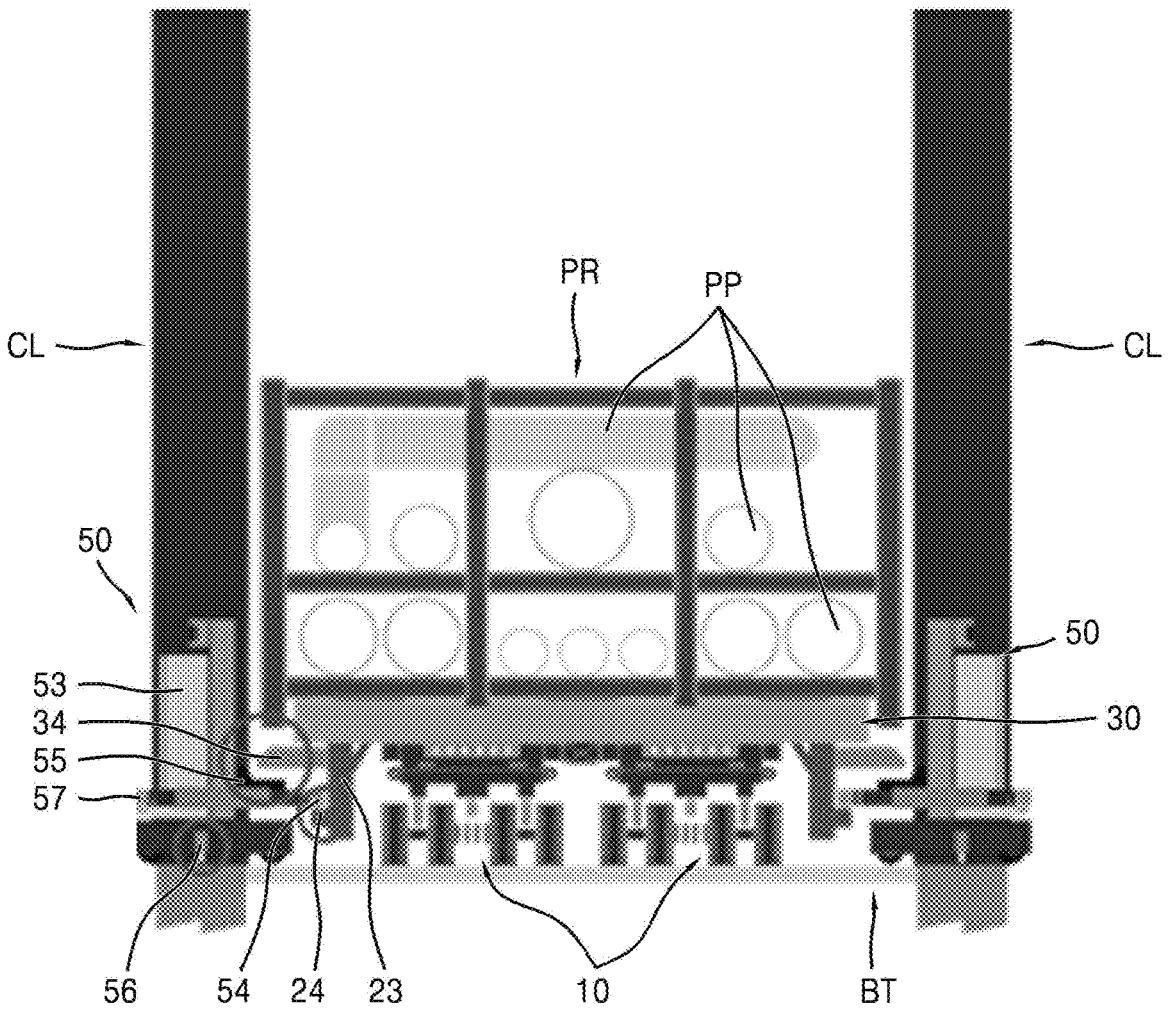
Figure 15:
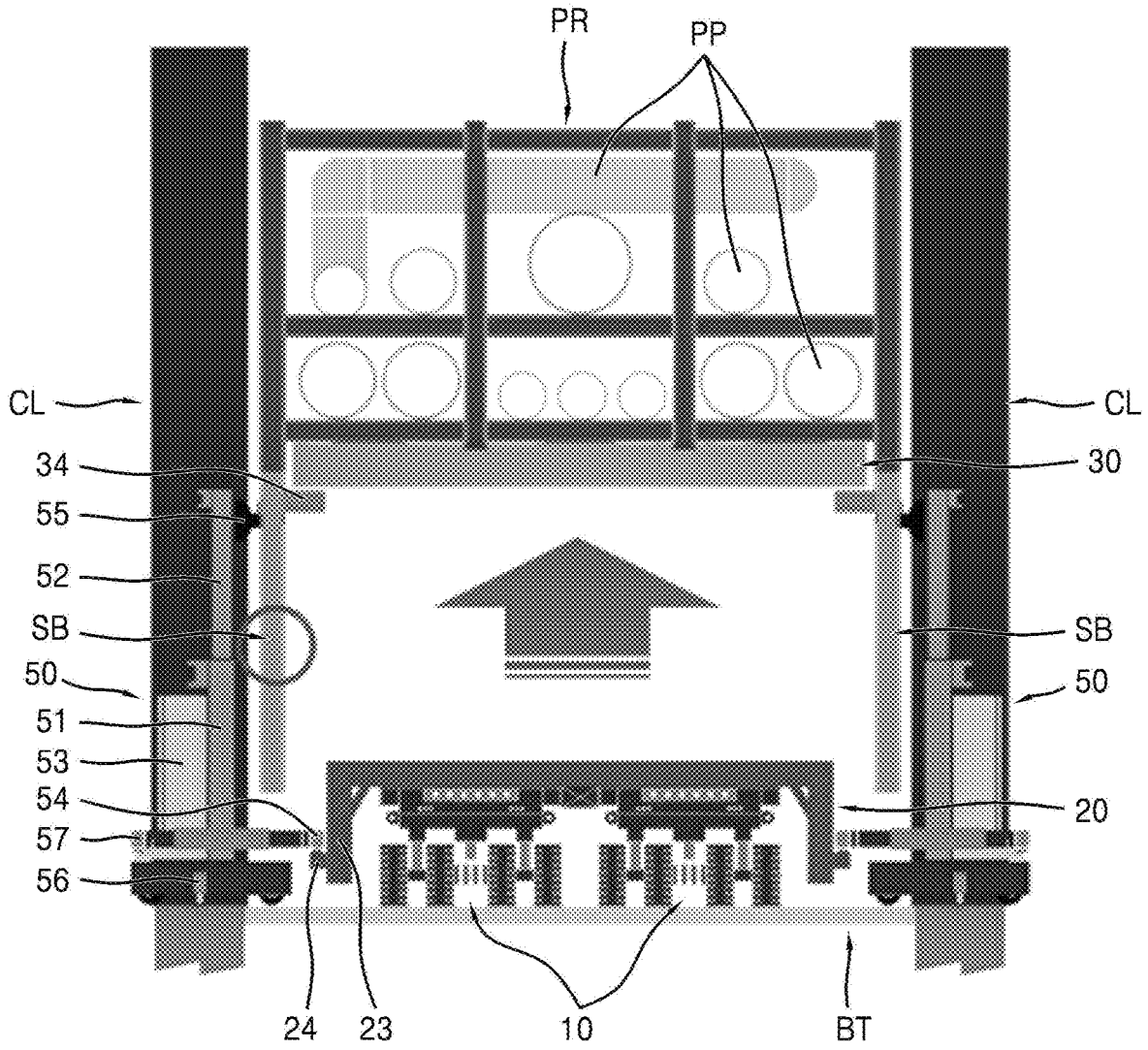

Next, as illustrated in FIGS. 14 and 15, after S60, by operating each stacker system 50, an outrigger support 24 of the support frame 20 may be pushed down by the front outriggers 54, and by pushing up an expandable fork support 34 of the lifting frame 30 by a fork 55, the lifting frame 30 may be separated and lifted from the support frame 20, thereby lifting the prefabricated steel structure PR (S70). Next, a support beam SB may be re-installed to the lower part of the prefabricated steel structure PR. In this case, after the load of the prefabricated steel structure PR may be sequentially transmitted to the fine position adjusting devices 40 and the lifting frame 30, the load may be firstly transmitted to the plurality of stacker systems 50 through the expandable fork supports 34 of the lifting frame 30 and the forks 55 of the stacker systems 50. Then, the load may be secondly transmitted to the entire support frame 20 through the front outriggers 54 of the stacker systems 50 and the outrigger supports 24 of the support frame 20, and then, the load may be thirdly transmitted to the entire moving cart 10 and then fourthly, through the wheels 12, may be evenly distributed to the entire bottom portion BT. As described above, according to a method of installing a prefabricated steel structure by using the above-described load dispersion-type indoor lifting apparatus for a prefabricated steel structure disclosed herein, a heavy steel structure can be lifted, and fixed and installed on a desired location even on indoor sites of a building with a low allowable load capacity for floor.

Next, as illustrated in FIG. 15, after S70, a plurality of support beams SB may be re-installed to the lower part of the prefabricated steel structure PR (S80).

Next, after S80, the position of the prefabricated steel structure PR may be finely adjusted by operating a plurality of fine position adjusting devices 40 mounted on the lifting frame 30 (S90).

Figure 16:
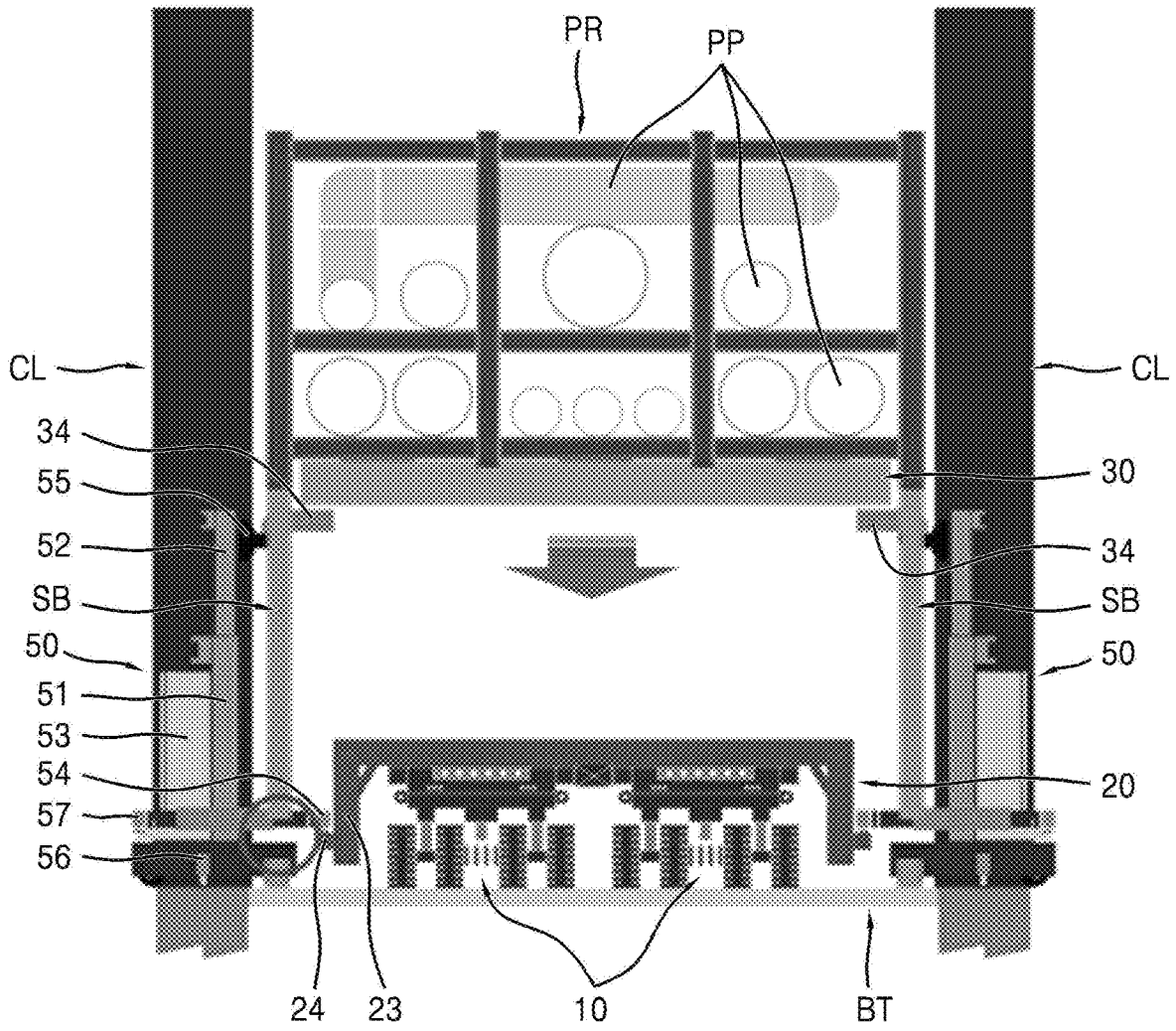
Figure 17:
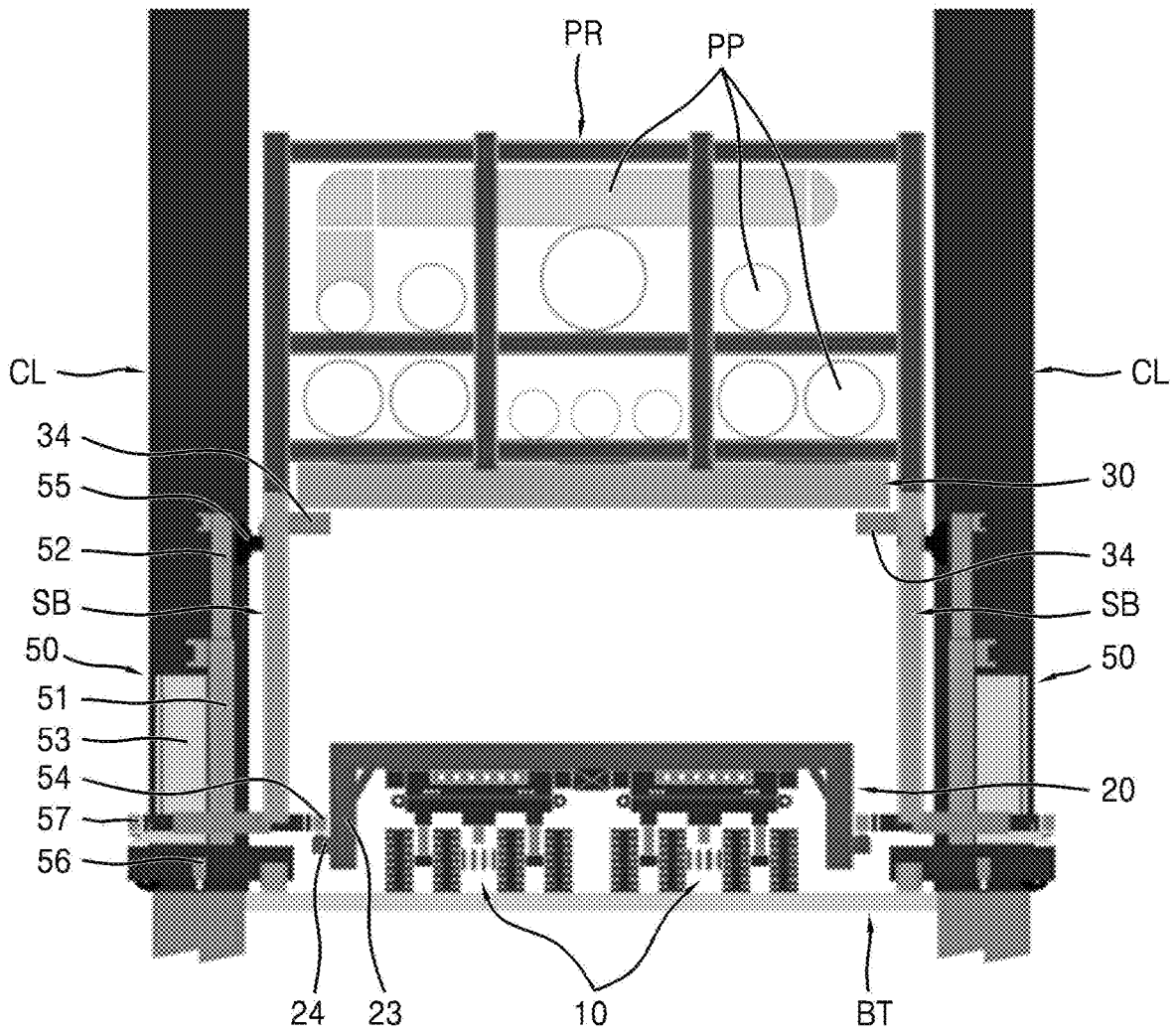

Next, as illustrated in FIGS. 16 and 17, after S90, the prefabricated steel structure PR may be lowered to a reference height by operating each stacker system 50 (S100).

Next, after S100, by operating each stacker system 50, the fork 55 may be lowered to thereby lower the lifting frame 30 together with an expandable fork support 34 of the lifting frame 30, the lifting frame 30 may be mounted on the support frame 20 to obtain the assembly again, and the front outriggers 54 may be raised and separated from the outrigger support 24 of the support frame 20 (S110).

Next, after S110, the communication line and the power cable connected to all of the plurality of stacker systems 50 may be separated and embedded inside the support frame 20 and the lifting frame 30 (S120).

Figure 18:
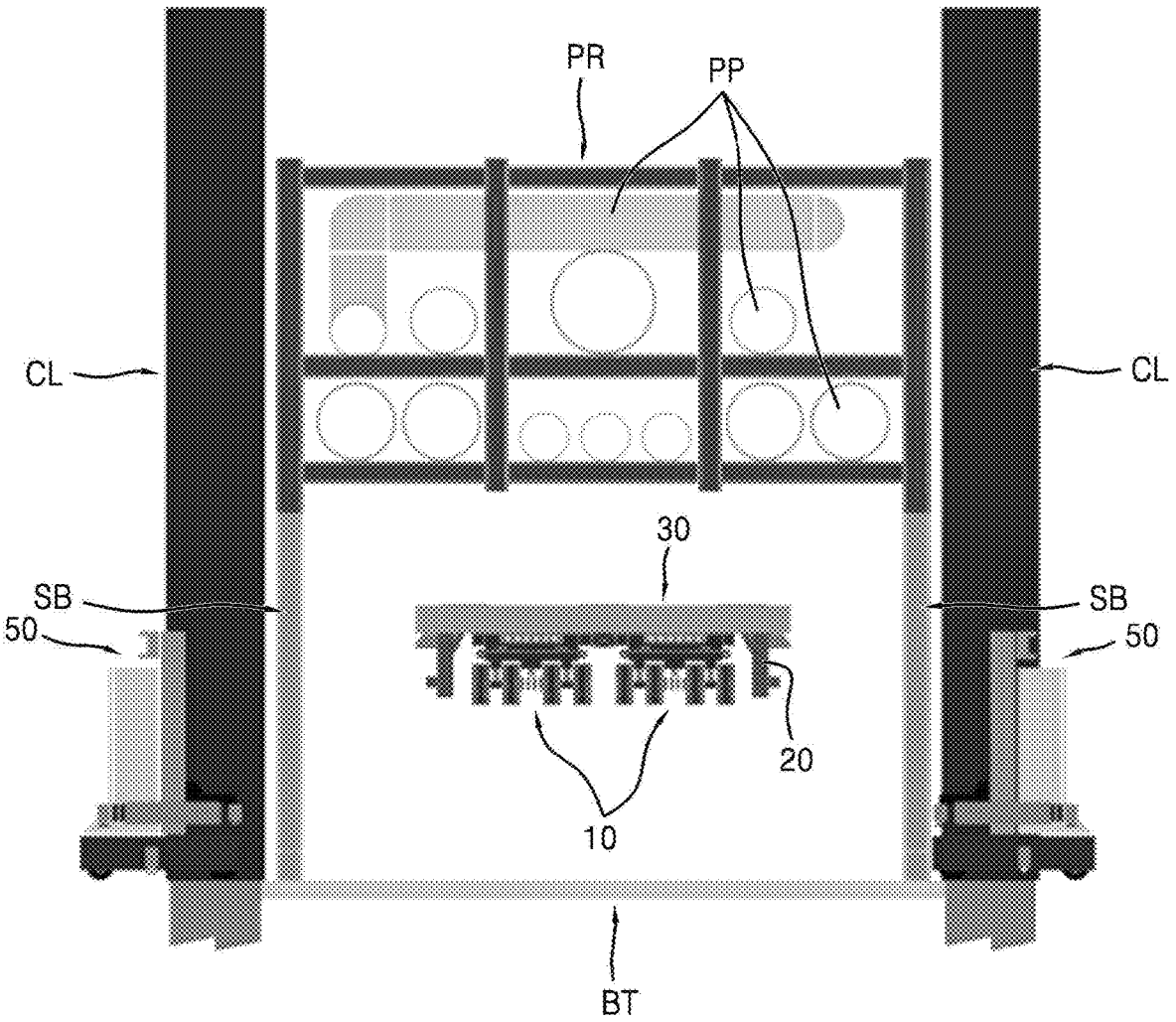

Next, as illustrated in FIG. 18, after S120, by operating the moving cart 10, the assembly may be moved from the lower part of the prefabricated steel structure PR to a storage site (S130).

Further, a method of installing a prefabricated steel structure by using a load dispersion-type indoor lifting apparatus for a prefabricated steel structure according to an embodiment of the disclosure may further include a control unit having functions as described below, wherein the control unit may include a plurality of buttons capable of executing various functions, and a display unit.

Although the present disclosure has been described with reference to the drawings, these embodiments are merely exemplary, and those skilled in the art shall understand that various modifications and equivalent other embodiments are possible therefrom. Therefore, the full scope of technical protection for the present disclosure shall be defined by the technical concept of the following claims.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A load dispersion-type indoor lifting apparatus for a prefabricated steel structure, the apparatus comprising:

a moving cart;

a support frame configured to be mounted on the moving cart;

a lifting frame configured to be mounted on the support frame; and a plurality of stacker systems configured to lift the lifting frame in an upward direction while pushing the support frame down, wherein the support frame comprises a plurality of outrigger supports being coupled to protrude outside of the outer edge of the support frame, wherein each of the plurality of stacker systems comprises a pair of front outriggers, wherein when the lifting frame is raised, and the support frame is fixed in position as the pair of front outriggers of the stacker system pushes down an outrigger support of the support frame, thereby the support frame and the lifting frame being separated from each other, wherein the pair of front outriggers pushes the plurality of outrigger supports of the support frame down, thereby distributing sequentially a load applied to the stacker system to the entire support frame and the entire moving cart, wherein the plurality of outrigger supports receive a load applied to the stacker system through the pair of front outriggers of the stacker system, and distribute the load applied to the stacker systems sequentially to the entire support frame and the entire moving cart, and wherein the support frame and the lifting frame are configured to partially overlap each other when coupled, such that a total thickness of an assembly of the support frame and the lifting frame is less than a sum of an actual thickness of the support frame and an actual thickness of the lifting frame.

2. The load dispersion-type indoor lifting apparatus of claim 1, wherein the support frame comprises a plurality of transverse bars spaced apart from each other and arranged parallel to each other, a plurality of longitudinal bars coupled with end portions of the plurality of transverse bars so as to connect the end portions of the plurality of transverse bars to each other, and a plurality of vertical bars spaced apart from each other and vertically coupled to an assembly of the plurality of transverse bars and the plurality of longitudinal bars.

3. The load dispersion-type indoor lifting apparatus of claim 2, wherein the support frame is configured such that the plurality of outrigger supports protrudes outward from and is coupled to lower end portions of the vertical bars, respectively.

4. The load dispersion-type indoor lifting apparatus of claim 2, wherein the support frame is configured to be separated into two or more parts, wherein among the plurality of longitudinal bars, two adjacent longitudinal bars are configured to be separated.

5. The load dispersion-type indoor lifting apparatus of claim 1, wherein the lifting frame comprises: a plurality of transverse bars spaced apart from each other and arranged parallel to each other; and a plurality of longitudinal bars coupled to end portions of the plurality of transverse bars so as to connect the end portions of the plurality of transverse bars to each other.

6. The load dispersion-type indoor lifting apparatus of claim 5, wherein the lifting frame further comprises a plurality of expandable fork supports coupled to bottom surfaces of the longitudinal bars while protruding outward from or being inwardly embedded into the bottom surfaces of the longitudinal bars, respectively.

7. The load dispersion-type indoor lifting apparatus of claim 6, wherein each of the plurality of expandable fork supports comprises a pin coupled to a bottom surface thereof.

8. The load dispersion-type indoor lifting apparatus of claim 5, wherein the lifting frame is configured to be separated into two or more parts, wherein among the plurality of longitudinal bars, two adjacent longitudinal bars are configured to be separated.

9. The load dispersion-type indoor lifting apparatus of claim 1, further comprising:

a plurality of fine position adjusting devices mounted on the lifting frame and configured to horizontally move or rotationally move the prefabricated steel structure.

10. The load dispersion-type indoor lifting apparatus of claim 1, wherein at least one of the support frame and the lifting frame further comprises a plurality of lifting lugs.

11. The load dispersion-type indoor lifting apparatus of claim 1, wherein each of the plurality of stacker systems further comprises a pair of first masts, a pair of second masts coupled to the pair of first masts in a vertically slidable manner, an electric panel, a fork coupled to the pair of second masts and configured to vertically slide together as the pair of second masts vertically slide, a pair of side outriggers, and a pair of rear outriggers.

12. The load dispersion-type indoor lifting apparatus of claim 11, wherein the fork comprises a hole formed in a top surface thereof.

13. The load dispersion-type indoor lifting apparatus of claim 11, wherein the pair of side outriggers, and the pair of rear outriggers have an automatic leveling function with respect to an unlevel bottom portion.

14. The load dispersion-type indoor lifting apparatus of claim 11, wherein each of the plurality of stacker systems further comprises a first mast reinforcing bar configured to couple the pair of first masts to each other to ensure structural safety of the pair of first masts and prevent deformation thereof.

15. The load dispersion-type indoor lifting apparatus of claim 11, wherein each stacker system further comprises a second mast reinforcing bar configured to couple the pair of second masts to each other to ensure structural safety of the pair of second masts and prevent deformation thereof.

16. The load dispersion-type indoor lifting apparatus of claim 1, further comprising:

a communication line embedded in the support frame and the lifting frame and configured to be connected to all of the plurality of stacker systems.

17. The load dispersion-type indoor lifting apparatus of claim 1, further comprising:

a power cable embedded in the support frame and the lifting frame and configured to be connected to all of the plurality of stacker systems.

18. The load dispersion-type indoor lifting apparatus of claim 1, further comprising:

a plurality of support beams configured to support a lower part of the prefabricated steel structure after the prefabricated steel structure is lifted.

19. The load dispersion-type indoor lifting apparatus of claim 11, further comprising:

at least one of a first additional support beam and a second additional support beam, wherein the first additional support beam is configured to support the rear outriggers of each stacker system, and the second additional support beam is configured to support the front outriggers and the rear outriggers while the side outriggers are in a folded state.

20. A method of installing a prefabricated steel structure by using the load dispersion-type indoor lifting apparatus of claim 1, the method comprising:

obtaining an assembly by mounting the lifting frame onto the support frame (S10);

by operating the moving cart, bringing the moving cart under a lower part of the assembly, and then attaching the lower part of the assembly and an upper part of the moving cart to each other (S20);

by operating the moving cart, moving the assembly under a lower part of a prefabricated steel structure, and then attaching the lower part of the prefabricated steel structure and an upper part of the assembly to each other (S30); and arranging the plurality of stacker systems in a row on one side and the other side of the assembly (S40).

21. The method of claim 20, further comprising:

after S40, connecting a communication line and a power cable, which are embedded in the support frame and the lifting frame, to all of the plurality of stacker systems (S50).

22. The method of claim 21, further comprising:

after S50, automatically leveling the stacker systems with respect to a level or unlevel bottom portion by adjusting a height of at least one outrigger selected from among a pair of front outriggers, a pair of side outriggers, and a pair of rear outriggers, of the stacker systems (S60).

23. The method of claim 22, wherein in S60, the side outriggers are extended to support the bottom portion, or the rear outriggers are extended to support an additional support beam pre-installed on the bottom portion.

24. The method of claim 22, further comprising:

after S60, operating each stacker system to push down outrigger supports of the support frame by the front outriggers, and by pushing up expandable fork supports of the lifting frame by a fork, separating and lifting the lifting frame from the support frame, thereby lifting the prefabricated steel structure (S70).

25. The method of claim 24, further comprising:

after S70, mounting a plurality of support beams onto a lower part of the prefabricated steel structure (S80).

26. The method of claim 25, further comprising:

after S80, operating a plurality of fine position adjusting devices mounted on the lifting frame to precisely adjust a position of the prefabricated steel structure (S90).

27. The method of claim 26, further comprising:

after S90, operating each stacker system to lower the prefabricated steel structure to a reference height (S100).

28. The method of claim 27, further comprising:

after S100, by operating each stacker system, lowering the fork to lower the lifting frame together with the expandable fork supports of the lifting frame, thereby mounting the lifting frame on the support frame to obtain the assembly again, and raising the front outriggers to thereby separate from the outrigger supports of the support frame (S110).

29. The method of claim 28, further comprising:

after S110, separating the communication line and the power cable, which are connected to all of the plurality of stacker systems, from each other and embedding the communication line and the power cable in the support frame and the lifting frame (S120).

30. The method of claim 29, further comprising:

after S120, operating the moving cart to move the assembly from the lower part of the prefabricated steel structure to a storage site (S130).

* * * * *